US011970857B1

(12) United States Patent
Attalla

(10) Patent No.: US 11,970,857 B1
(45) **Date of Patent: *Apr. 30, 2024**

(54) STIFF WALL PANEL ASSEMBLY FOR A BUILDING STRUCTURE AND ASSOCIATED METHOD(S)

(71) Applicant: Anthony Attalla, Navarre, FL (US)

(72) Inventor: Anthony Attalla, Navarre, FL (US)

( * ) Notice: Subject to any disclaimer, the term of this patent is extended or adjusted under 35 U.S.C. 154(b) by 90 days.

This patent is subject to a terminal disclaimer.

(21) Appl. No.: 18/190,092

(22) Filed: Mar. 26, 2023

Related U.S. Application Data

(63) Continuation-in-part of application No. 18/055,448, filed on Nov. 15, 2022, now Pat. No. 11,643,818.

(51) Int. Cl.

| | |
|---|---|
| ***E04C 2/38*** | (2006.01) |
| ***E04B 2/60*** | (2006.01) |
| ***E04C 2/08*** | (2006.01) |
| *E04C 2/00* | (2006.01) |

(52) U.S. Cl.
CPC ..... *E04C 2/384* (2013.01); *E04B 2/60* (2013.01); *E04C 2/08* (2013.01); *E04B 2103/06* (2013.01); *E04C 2002/004* (2013.01)

(58) Field of Classification Search
CPC ..... E04C 2/384; E04C 2/08; E04B 2/60
USPC ..... 52/798.1
See application file for complete search history.

(56) References Cited

U.S. PATENT DOCUMENTS

| | | | | | |
|---|---|---|---|---|---|
| 3,018,859 | A * | 1/1962 | Struben | E04B 1/24 | 52/591.1 |
| 3,037,590 | A * | 6/1962 | Pavlecka | E04C 2/08 | 52/592.1 |
| 3,196,992 | A * | 7/1965 | Owen | E06B 1/38 | 52/204.7 |
| 3,217,452 | A * | 11/1965 | Steele | E04B 2/7845 | 52/584.1 |
| 3,225,726 | A * | 12/1965 | Tennison, Jr. | B21D 5/08 | 29/417 |
| 3,819,466 | A * | 6/1974 | Winfield | B32B 3/28 | 52/783.17 |
| 3,841,043 | A * | 10/1974 | Zinn | E04B 2/7881 | 52/243 |
| 4,158,936 | A * | 6/1979 | Fulton | E04B 2/7425 | 52/794.1 |
| 4,471,592 | A * | 9/1984 | MacKinnon, Jr. | E04B 1/7675 | 52/712 |

(Continued)

*Primary Examiner* — Brian D Mattei
*Assistant Examiner* — Joseph J. Sadlon
(74) *Attorney, Agent, or Firm* — Ashkan Najafi

(57) ABSTRACT

A modular stiff wall panel assembly for a building structure includes a modular wall panel having a central portion has central ribs spaced therealong, a first wall track engaged with the central portion and having first ribs spaced therealong, and a second wall track engaged with the central portion and having second ribs spaced therealong wherein the second wall track is oppositely spaced from the first wall track, and a plurality of studs engaged with the central portion, the first wall track, and the second wall track. The central ribs, the first ribs, and the second ribs are linearly aligned, respectively, and registered parallel to a longitudinal axis of the studs, respectively. The central ribs, the first ribs, and the second ribs are coplanar on a single plane and disposed at an end-to-end pattern along an entire longitudinal length of the wall panel.

19 Claims, 20 Drawing Sheets

(56) References Cited

U.S. PATENT DOCUMENTS 4,793,113 A * 12/1988 Bodnar ..... E04B 2/58 52/634
5,215,361 A * 6/1993 Brock, Jr. ..... A47B 13/003 403/231
5,497,591 A * 3/1996 Nelson ..... E04B 2/60 52/289
5,628,495 A * 5/1997 Gandara ..... E04H 17/165 256/73
5,692,345 A * 12/1997 Mogaki ..... E04F 13/0812 52/489.1
7,231,746 B2 * 6/2007 Bodnar ..... E04C 2/384 52/649.3
7,690,167 B2 * 4/2010 Antonic ..... E04C 3/29 52/489.1
7,900,681 B2 * 3/2011 Sweeney ..... E06B 9/04 49/67
8,322,115 B2 * 12/2012 Foell ..... E04B 2/86 52/745.1
8,555,590 B2 * 10/2013 Richardson ..... E04G 11/06 52/421
8,671,637 B2 * 3/2014 LeBlang ..... E04B 1/14 52/309.4
9,562,359 B1 * 2/2017 Grisolia ..... B32B 3/266
9,689,162 B2 * 6/2017 Cullen ..... E04F 13/0807
10,480,185 B1 * 11/2019 Attalla ..... E04F 13/0807
10,577,787 B2 * 3/2020 Ovrum ..... E04B 1/28
10,760,266 B2 * 9/2020 Sacks ..... E04C 3/32
10,822,793 B2 * 11/2020 Yu ..... E04B 2/56
11,549,260 B2 * 1/2023 Fatcheric ..... E04F 13/0882
11,718,984 B2 * 8/2023 Tiramani ..... B32B 15/18 52/79.5
2007/0193184 A1 * 8/2007 Mann ..... E04H 17/16 52/630
2009/0000246 A1 * 1/2009 Chang ..... E04C 2/36 52/783.11
2016/0053486 A1 * 2/2016 Agda ..... E04H 17/16 52/630
2021/0071410 A1 * 3/2021 Kralic ..... B32B 3/28 52/783.17
2022/0325522 A1 * 10/2022 Hartwick ..... E04C 2/288

* cited by examiner

STIFF WALL PANEL ASSEMBLY FOR A BUILDING STRUCTURE AND ASSOCIATED METHOD(S)

CROSS REFERENCE TO RELATED APPLICATIONS

This is a U.S. continuation-in-part application that claims priority to and benefit of currently U.S. non-provisional patent application Ser. No. 18/055,448, filed Nov. 15, 2022, which claims priority to and benefit of U.S. provisional patent application No. 63/368,450 filed Jul. 14, 2022, which are incorporated by reference herein in their entireties.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to wall panel assemblies and, more particularly, to a specially configured modular steel stiff wall panel assembly for providing improved resistance to shear forces, racking forces, and impact forces.

Prior Art

Stick frame construction or simply stick construction is used for a large portion of the frame of a building, is used in a large percentage of smaller scale building construction projects. Stick construction utilizes studs, lightweight materials, typically either wood or metal, to construct the frame, including walls, floor joists and roof trusses of the building under construction, wood studs being typical in residential construction and metal studs being typical in commercial construction. Stick frame construction produces a building frame that has a relatively high strength to weight ratio.

While a strong frame can be produced using standard stick frame construction, there is room for improvement. One issue building design engineers grapple with is trying to increase the shear strength of the frame built, especially, the vertical or wall components of the frame. A stick frame constructed building is subject to in plane lateral forces, caused by wind and earthquakes. If such in plane force is sufficiently strong, the building can be subject to racking, wherein the walls of the building come out of square. Racking causes damage to carious components of the building, including the walls, both interior and exterior, cabinets, doors and windows, flooring, especially upper story flooring, and in extreme cases, structural failure.

In wood stick frame construction, engineers focus on the strength of the wood used to produce the stud as well as bracing the frame and the walls via sheathing and other methods, in order to increase the shear strength of the structure built in order to thereby reduce the potential for racking. In addition to these considerations, in metal stick construction, engineers also focus on the geometry of the frame, particularly the stud, to increase the overall shear strength of the stud and thereby increase overall shear strength of the frame produced.

Accordingly, a need remains for a modular stiff wall panel assembly in order to overcome at least one of the above-noted shortcomings. The exemplary embodiment(s) satisfy such a need by a specially configured modular stiff wall panel assembly that is convenient and easy to use, lightweight yet durable in design, versatile in its applications, and designed for providing improved resistance to shear forces, racking forces, and impact forces

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a specially configured modular stiff wall panel assembly for providing improved resistance to shear forces, racking forces, and impact forces. These and other objects, features, and advantages of the non-limiting exemplary embodiment(s) are provided by a modular stiff wall panel assembly for a building structure, including a modular wall panel having a body provided with a plurality of single, continuous, and unitary layers extended along an entire surface area of the modular wall panel. Such a plurality of single, continuous, and unitary layers include a central portion having a plurality of central ribs spaced therealong, a first wall track engaged with the central portion and having a plurality of first ribs spaced therealong, and a second wall track engaged with the central portion and having a plurality of second ribs spaced therealong wherein the second wall track is oppositely spaced from the first wall track; and a plurality of studs engaged with the central portion, the first wall track, and the second wall track. Advantageously, the central ribs, the first ribs, and the second ribs are linearly aligned, respectively, and registered parallel to a longitudinal axis of the studs, respectively. Advantageously, the central ribs, the first ribs, and the second ribs are coplanar on a single plane and disposed at an end-to-end pattern along an entire longitudinal length of the wall panel.

In a non-limiting exemplary embodiment, each of the longitudinal length of the wall panel and the longitudinal axis of the studs is oriented orthogonal to a horizontal ground surface.

In a non-limiting exemplary embodiment, each of the longitudinal length of the wall panel and the longitudinal axis of the studs is oriented parallel to a horizontal ground surface.

In a non-limiting exemplary embodiment, the central ribs are equidistantly spaced along the central portion and registered orthogonal to a longitudinal axis of the central portion.

In a non-limiting exemplary embodiment, the first ribs are registered orthogonal to a longitudinal axis of the first wall track.

In a non-limiting exemplary embodiment, the seconds ribs are registered orthogonal to a longitudinal axis of the second wall track.

In a non-limiting exemplary embodiment, the first wall track is oriented parallel to the second wall track and spaced apart therefrom.

In a non-limiting exemplary embodiment, the central ribs are integral with the central portion and linearly parallel to a latitudinal axis thereof.

In a non-limiting exemplary embodiment, the central ribs are parallel to the first ribs and the second ribs.

In a non-limiting exemplary embodiment, the central ribs, the first ribs, and the second ribs are linearly disposed along the single plane.

In a non-limiting exemplary embodiment, each of the first ribs, the second ribs, and the central ribs are rectilinear.

In a non-limiting exemplary embodiment, a plurality of fasteners connected to a plurality of intersecting junctures of the first wall track, the second wall track, and the central portion, respectively.

In a non-limiting exemplary embodiment, the central portion is removably attached to the studs.

In a non-limiting exemplary embodiment, each of the first wall track and the second wall track has a single stiffening lip longitudinally extended orthogonal to the studs and oppositely spaced from the central portion. Advantageously, the first ribs and the second ribs are spaced from the single stiffening lip, respectively.

In a non-limiting exemplary embodiment, the central portion is separate from and detachably coupled to each of the first wall track and the second wall track.

In a non-limiting exemplary embodiment, the each of the single stiffening lip has a continuous planar anterior face and a continuous planar posterior face.

In a non-limiting exemplary embodiment, the first wall track includes a first primary side having the first ribs, a first base integral with the first primary side and oriented perpendicular thereto, and a first stiffening lip integral with the first base and oriented perpendicular thereto. Advantageously, the first stiffening lip is spaced from the first ribs and has a first planar anterior face as well as a first planar posterior face oriented parallel to the first primary side. Advantageously, a proximal end of each of the studs is intercalated between the first primary side and the first stiffening lip.

In a non-limiting exemplary embodiment, the second wall track includes a second primary side having the second ribs, a second base integral with the second primary side and oriented perpendicular thereto, and a second stiffening lip integral with the second base and oriented perpendicular thereto. Advantageously, the second stiffening lip is spaced from the second ribs and has a second planar anterior face as well as a second planar posterior face oriented parallel to the second primary side. Advantageously, a distal end of each of the studs is intercalated between the second primary side and the second stiffening lip.

In a non-limiting exemplary embodiment, the central ribs begin and terminate at the central portion. Advantageously, the first ribs begin and terminate at the first wall track and the second ribs begin and terminate at the second wall track.

In a non-limiting exemplary embodiment, each of the studs has a proximal end and a distal end directly abutted with the first wall track and the second wall track, respectively.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
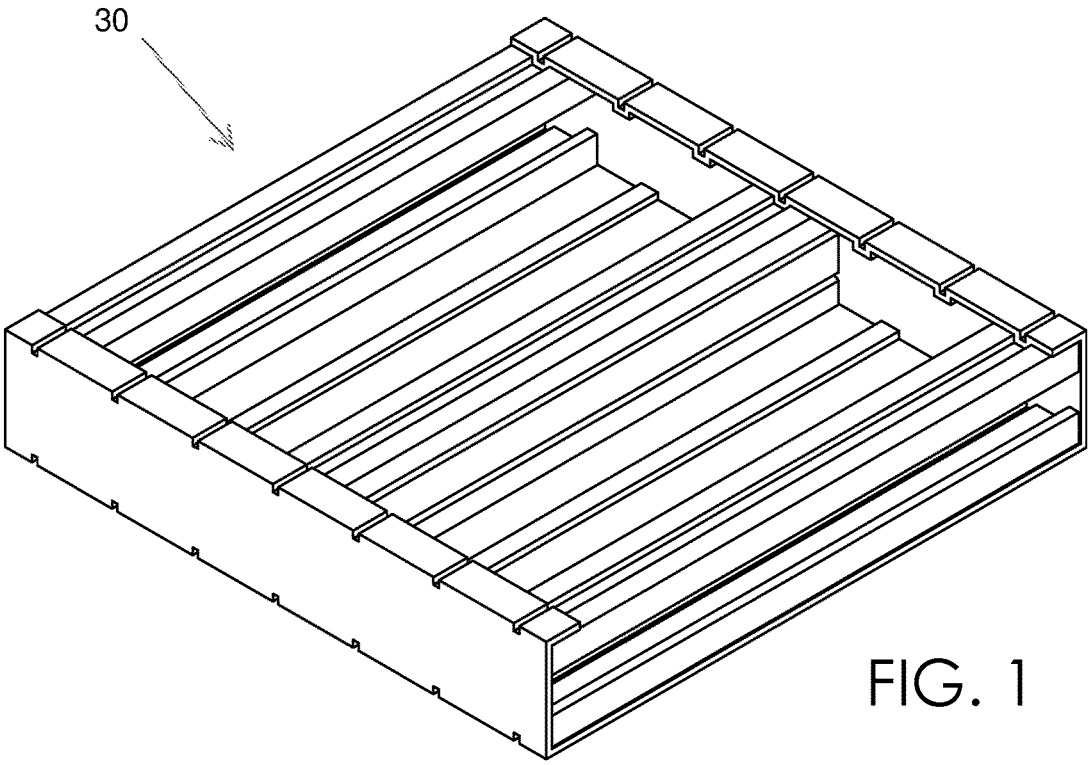
FIG. 1 is a perspective view of a stiff wall panel assembly wherein the wall panel is detachable form the tracks, each having ribs parallel to the studs, in accordance with a non-limiting exemplary embodiment of the present disclosure.
Figure 2:
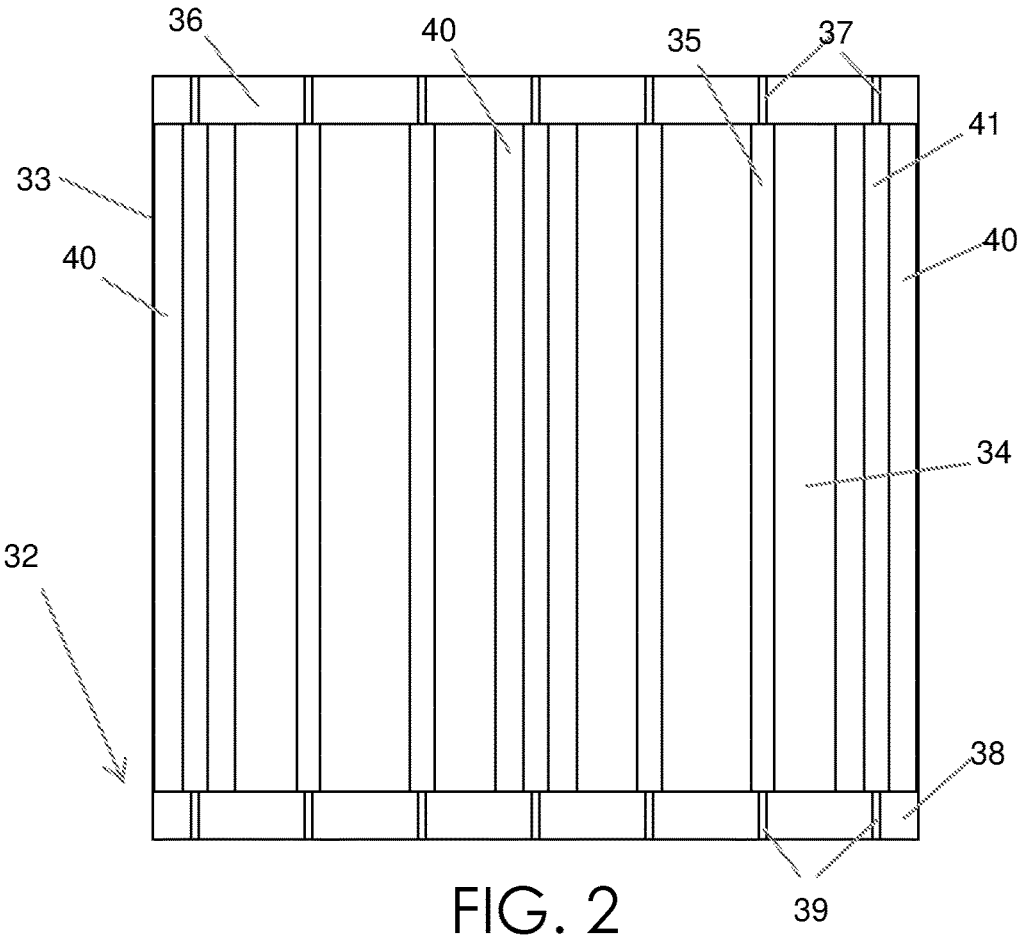
FIG. 2 is a rear elevational view of the stiff wall panel assembly shown in FIG. 1, in accordance with a non-limiting exemplary embodiment of the present disclosure.
Figure 3:
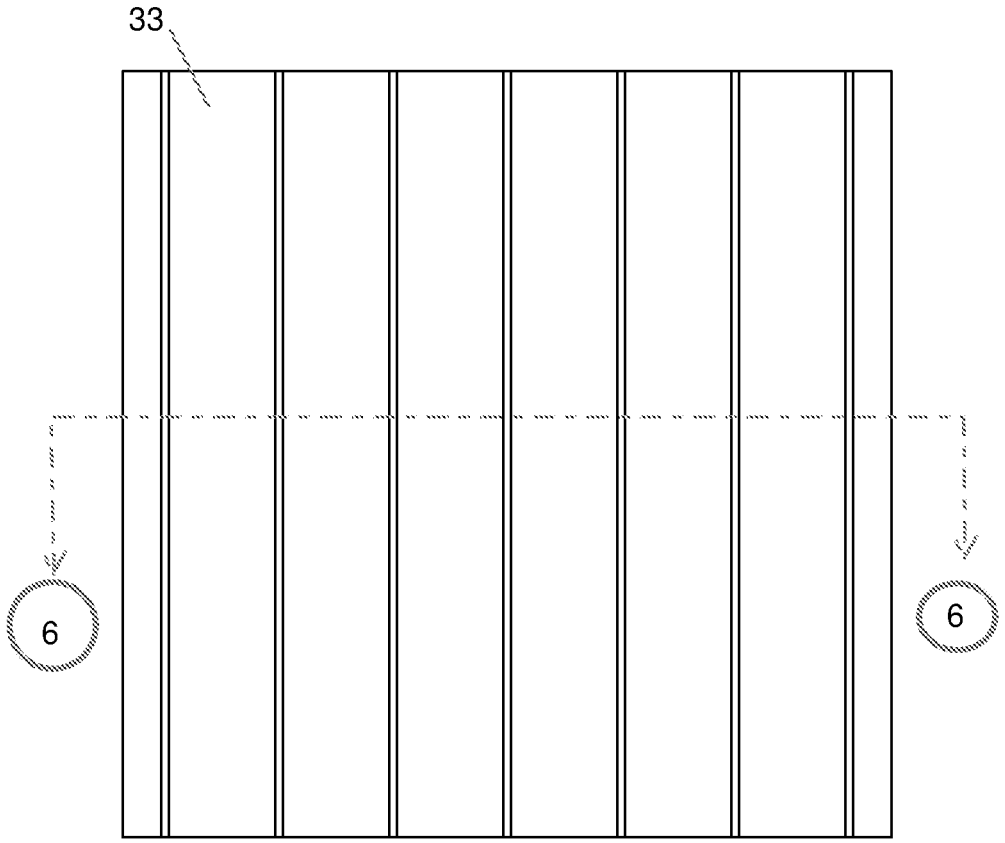
FIG. 3 is a front elevational view of the stiff wall panel assembly shown in FIG. 1, in accordance with a non-limiting exemplary embodiment of the present disclosure.
Figure 4:
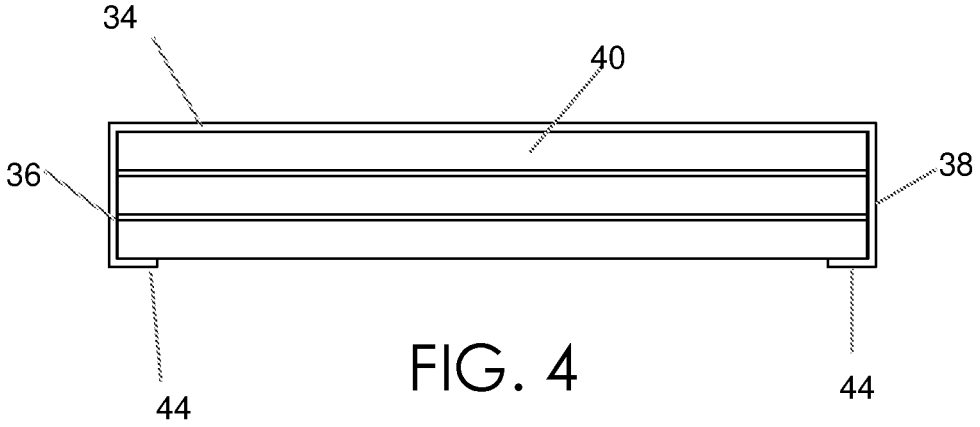
FIG. 4 is a side elevational view of the stiff wall panel assembly shown in FIG. 1, in accordance with a non-limiting exemplary embodiment of the present disclosure.
Figure 5:
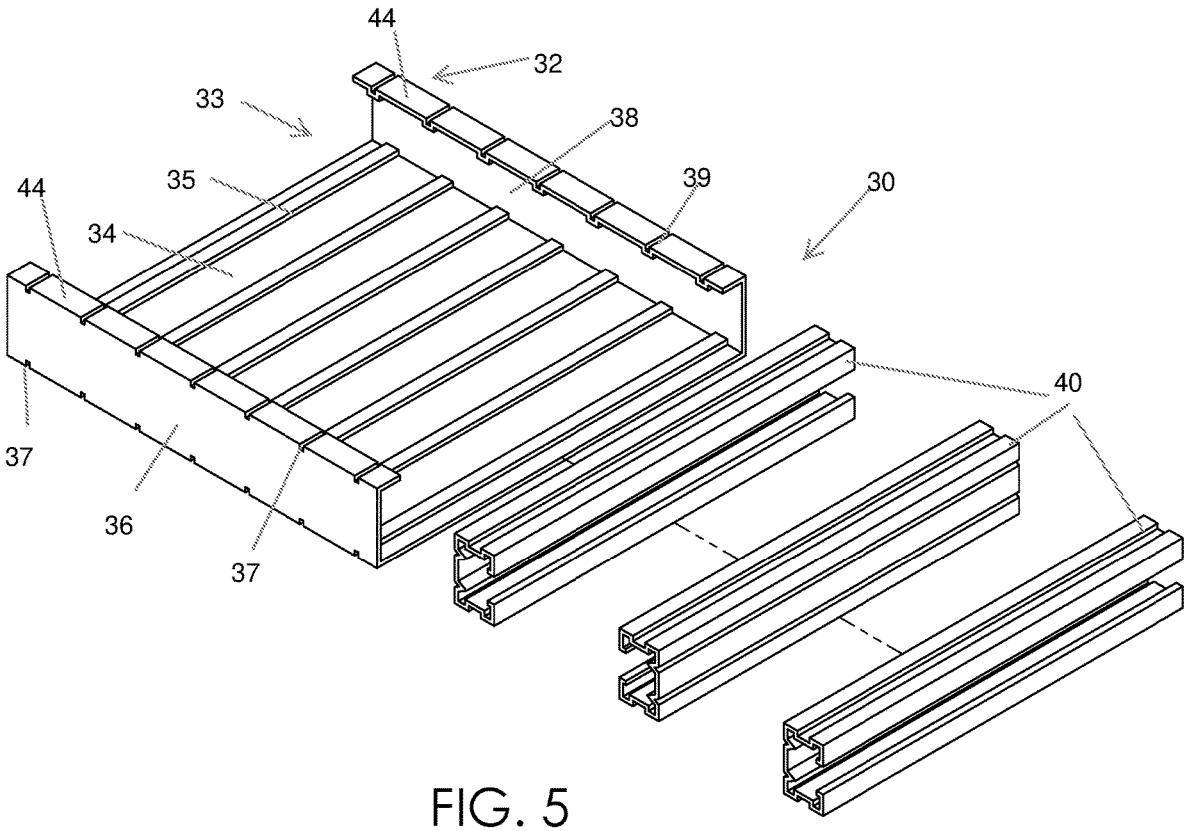
FIG. 5 is an exploded view of the stiff wall panel assembly shown in FIG. 1, in accordance with a non-limiting exemplary embodiment of the present disclosure.
Figure 6:
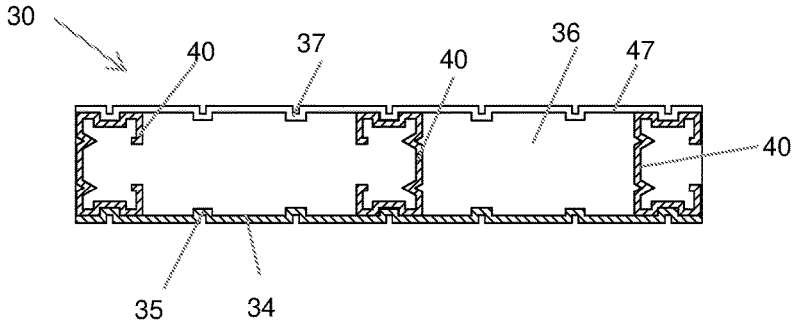
FIG. 6 is a cross-sectional view taken along line 6-6 in FIG. 3, in accordance with a non-limiting exemplary embodiment of the present disclosure.
Figure 7:
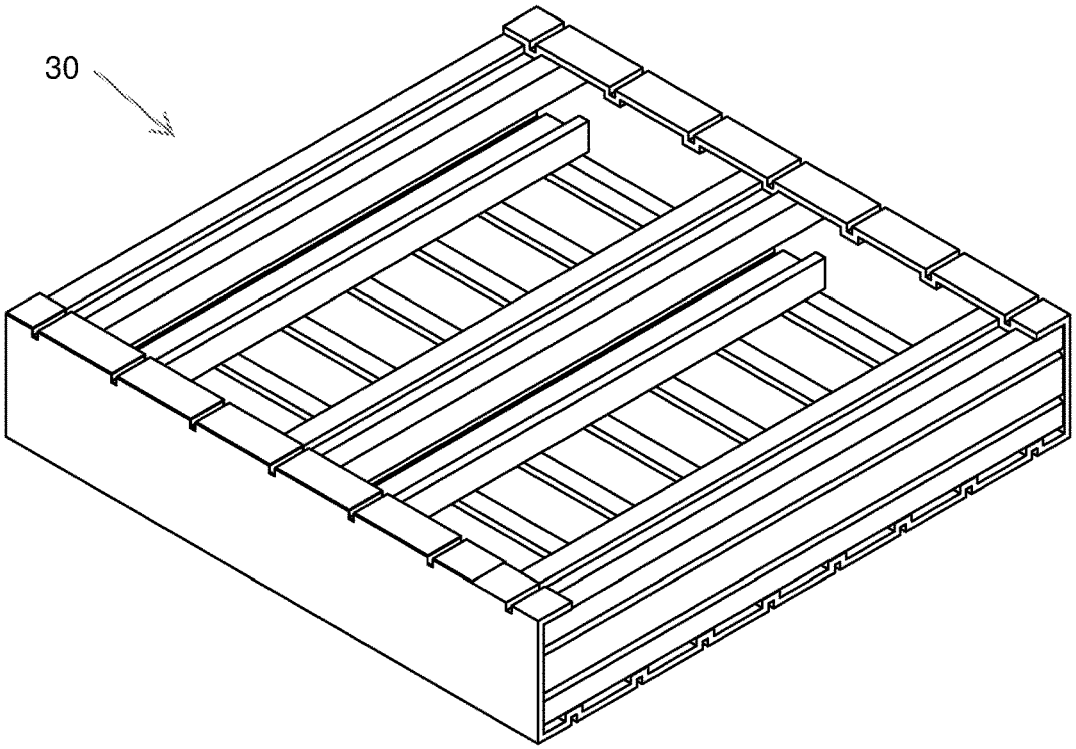
FIG. 7 is a perspective view of a stiff wall panel assembly wherein the wall panel is detachable from the tracks, each having ribs orthogonal and parallel to the studs, respectively, in accordance with a non-limiting exemplary embodiment of the present disclosure.
Figure 8:
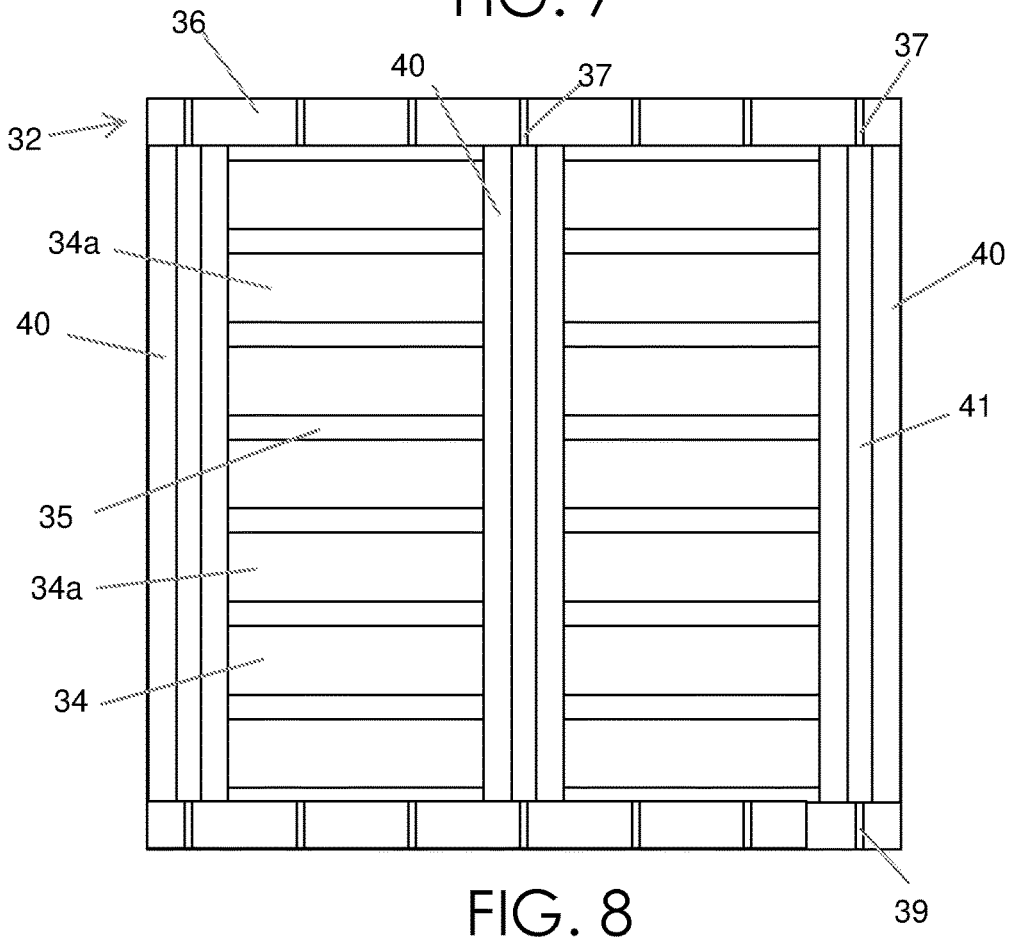
FIG. 8 is a rear elevational view of the stiff wall panel assembly shown in FIG. 7, in accordance with a non-limiting exemplary embodiment of the present disclosure.
Figure 9:
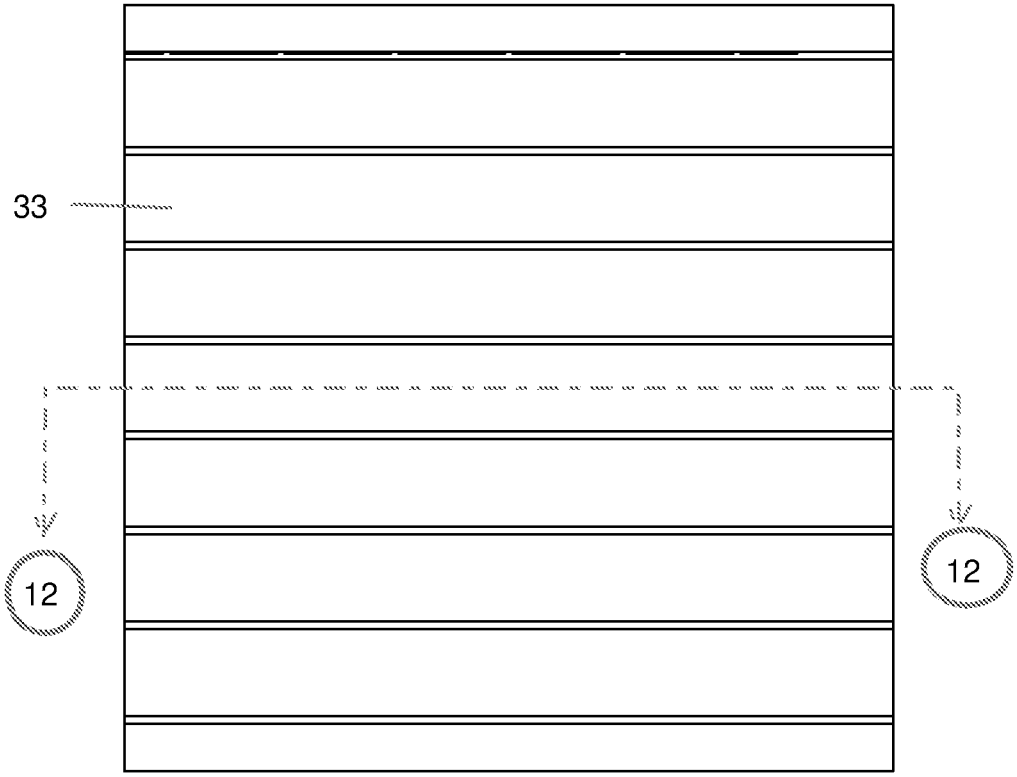
FIG. 9 is a front elevational view of the stiff wall panel assembly shown in FIG. 7, in accordance with a non-limiting exemplary embodiment of the present disclosure.
Figure 10:
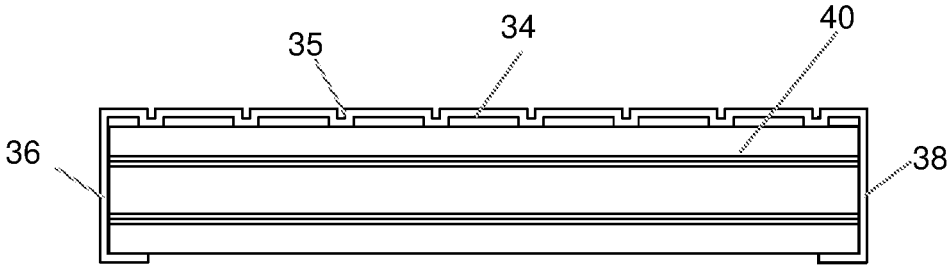
FIG. 10 is a side elevational view of the stiff wall panel assembly shown in FIG. 7, in accordance with a non-limiting exemplary embodiment of the present disclosure.
Figure 11:
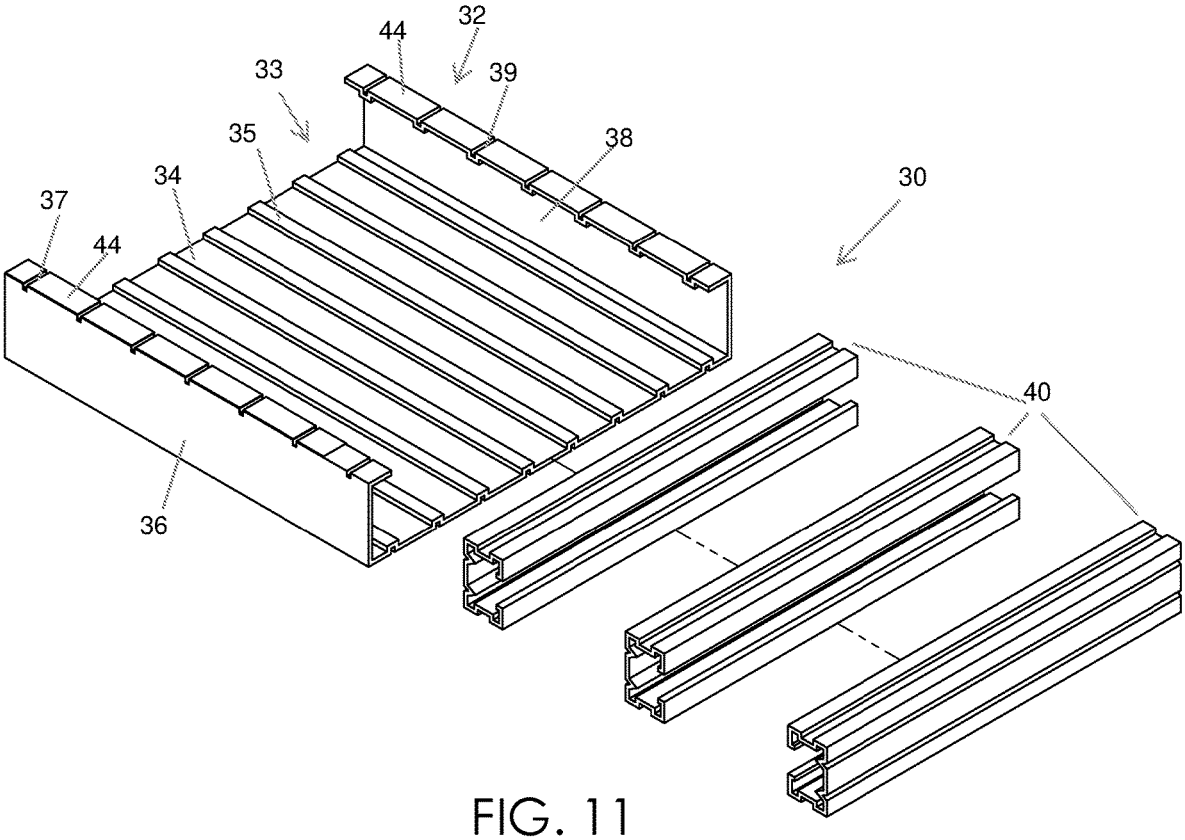
FIG. 11 is an exploded view of the stiff wall panel assembly shown in FIG. 7, in accordance with a non-limiting exemplary embodiment of the present disclosure.
Figure 12:
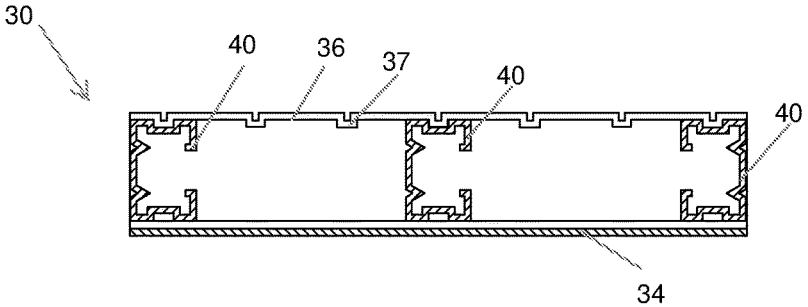
FIG. 12 is a cross-sectional view taken along line 12-12 in FIG. 9, in accordance with a non-limiting exemplary embodiment of the present disclosure.
Figure 13:
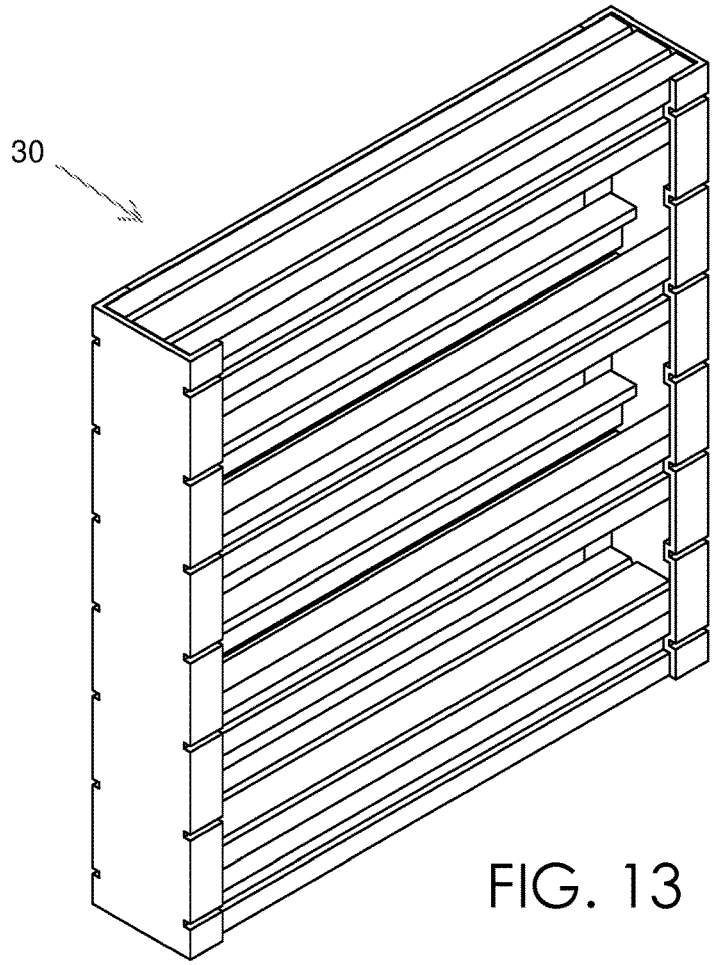
FIG. 13 is a perspective view of a stiff wall panel assembly wherein the wall panel is detachable from the tracks, each having ribs parallel to the studs, in accordance with a non-limiting exemplary embodiment of the present disclosure.
Figure 14:
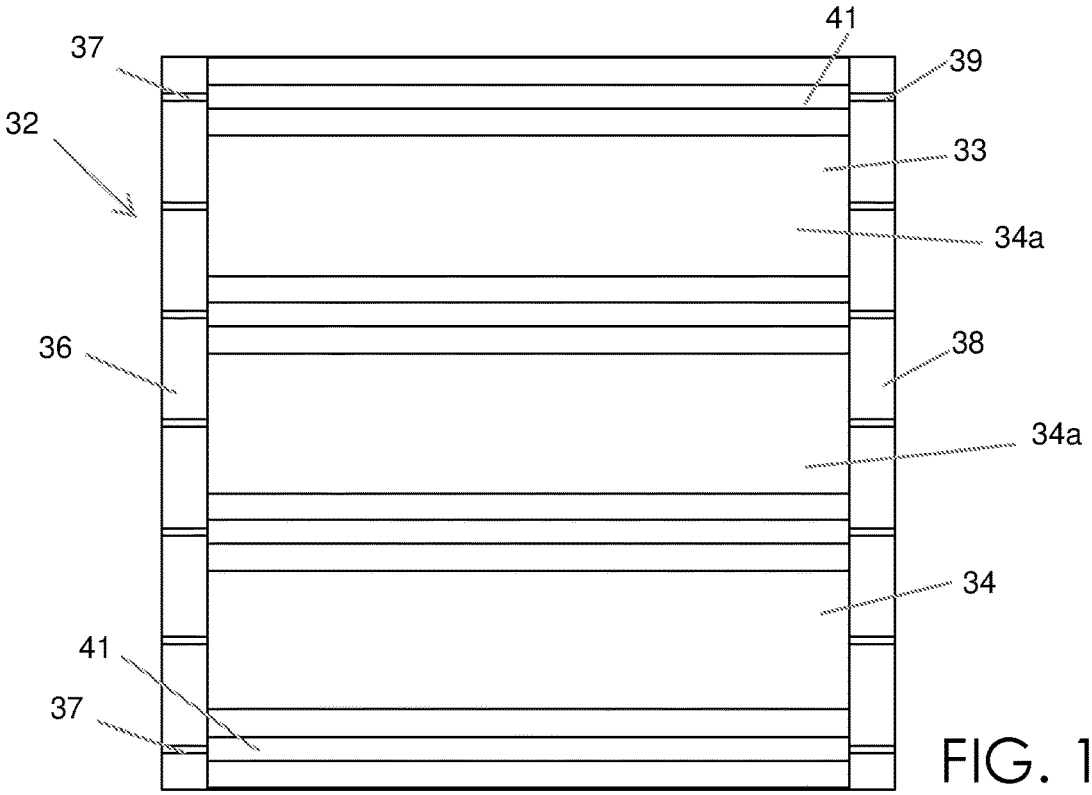
FIG. 14 is a rear elevational view of the stiff wall panel assembly shown in FIG. 13, in accordance with a non-limiting exemplary embodiment of the present disclosure.
Figure 15:
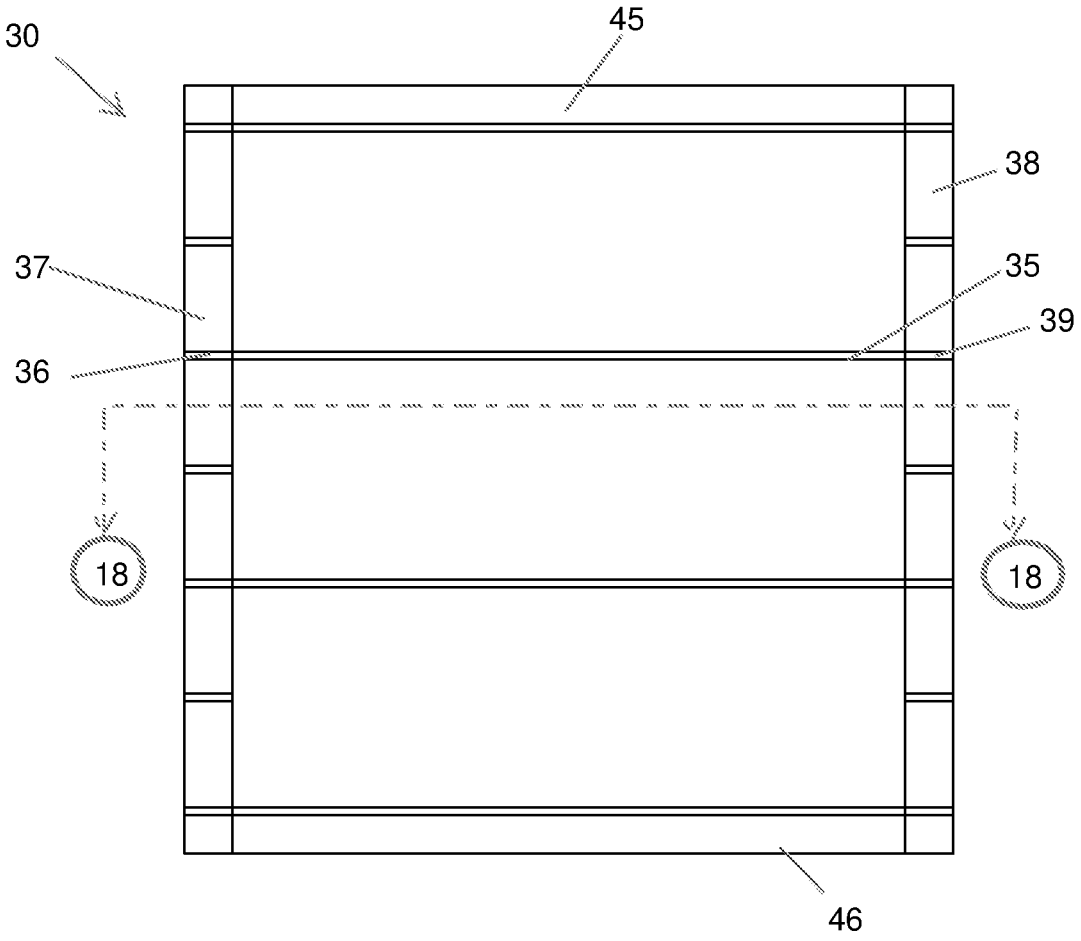
FIG. 15 is a front elevational view of the stiff wall panel assembly shown in FIG. 13, in accordance with a non-limiting exemplary embodiment of the present disclosure.
Figure 16:
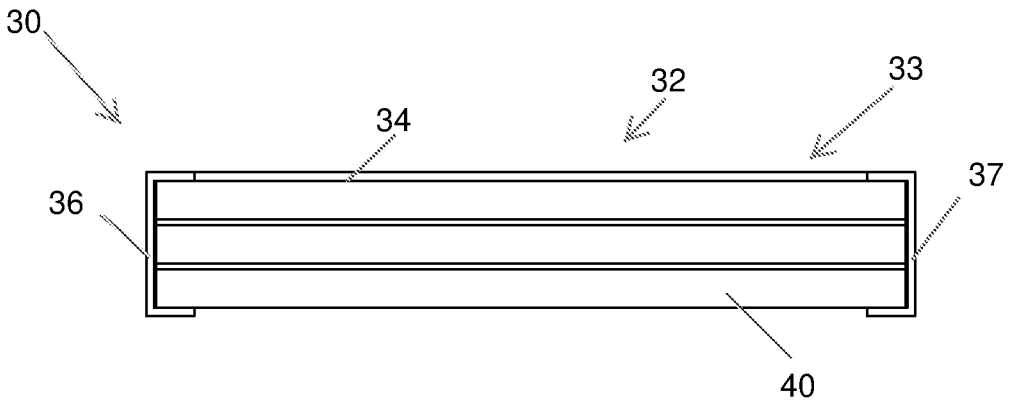
FIG. 16 is a top plan view of the stiff wall panel assembly shown in FIG. 13, in accordance with a non-limiting exemplary embodiment of the present disclosure.
Figure 17:
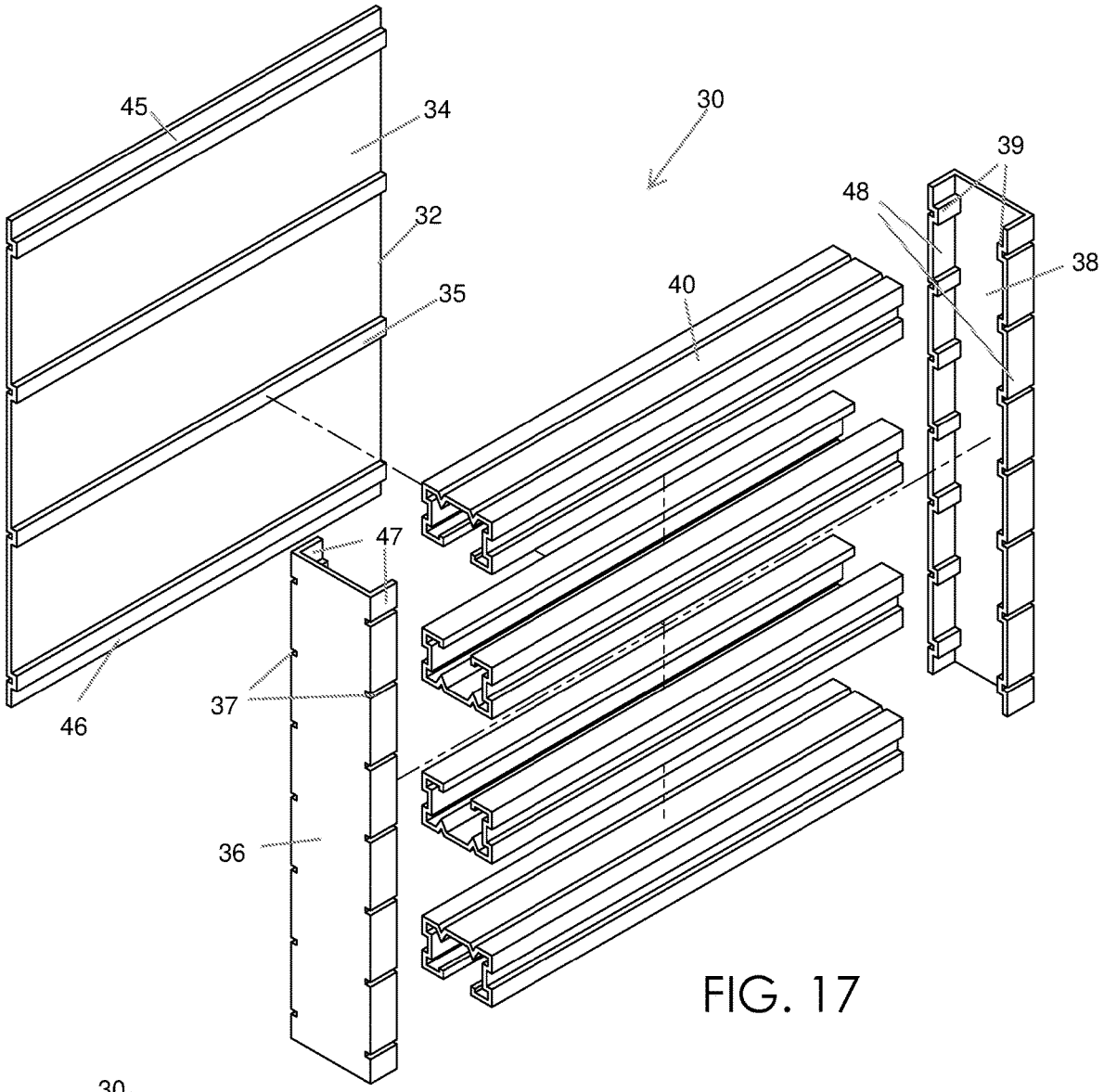
FIG. 17 is an exploded view of the stiff wall panel assembly shown in FIG. 13, in accordance with a non-limiting exemplary embodiment of the present disclosure.
Figure 18:
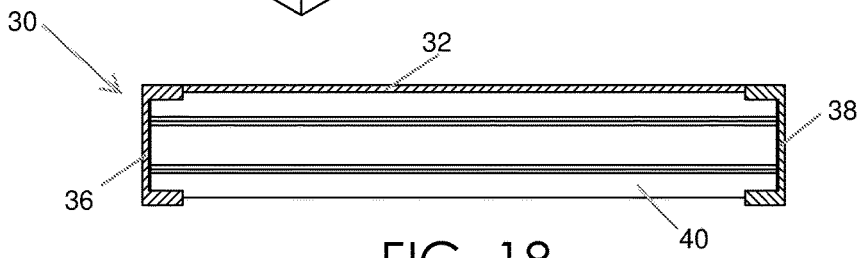
FIG. 18 is a cross-sectional view taken along line 18-18 in FIG. 15, in accordance with a non-limiting exemplary embodiment of the present disclosure.
Figure 19:
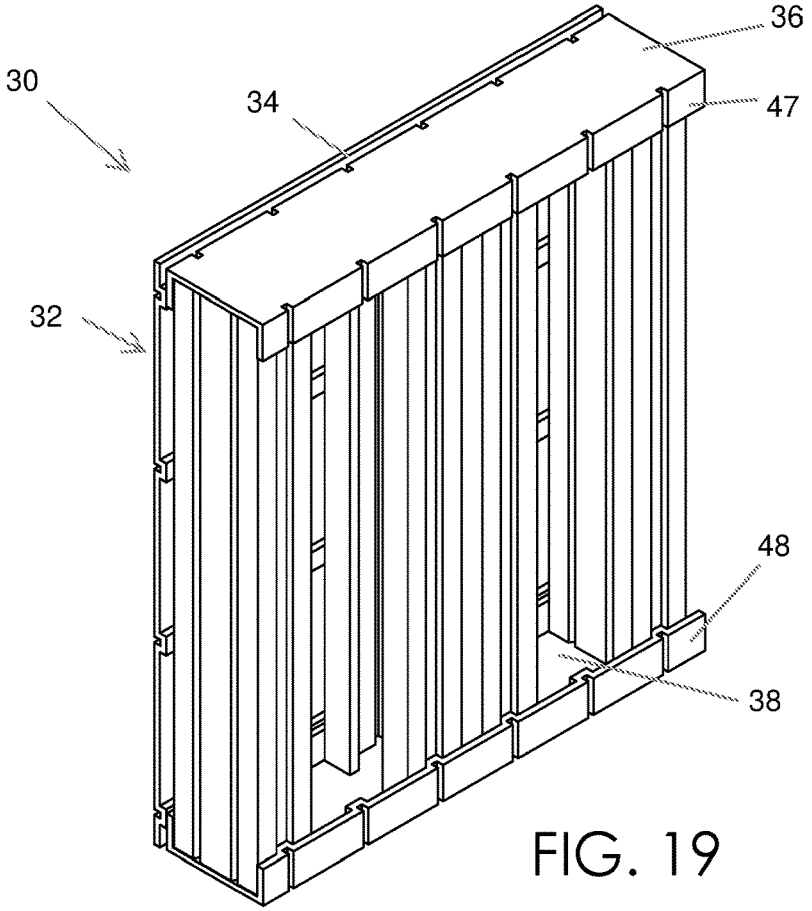
FIG. 19 is a perspective view of a stiff wall panel assembly wherein the wall panel is detachable from the tracks, each having ribs orthogonal and parallel to the studs, respectively, in accordance with a non-limiting exemplary embodiment of the present disclosure.
Figure 20:
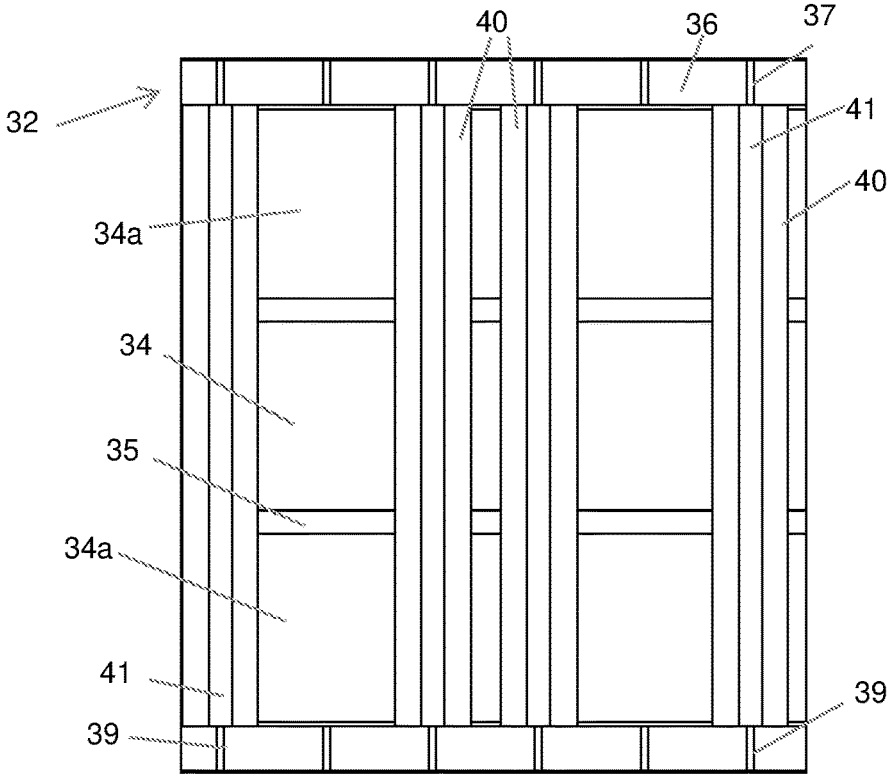
FIG. 20 is a rear elevational view of the stiff wall panel assembly shown in FIG. 19, in accordance with a non-limiting exemplary embodiment of the present disclosure.
Figure 21:
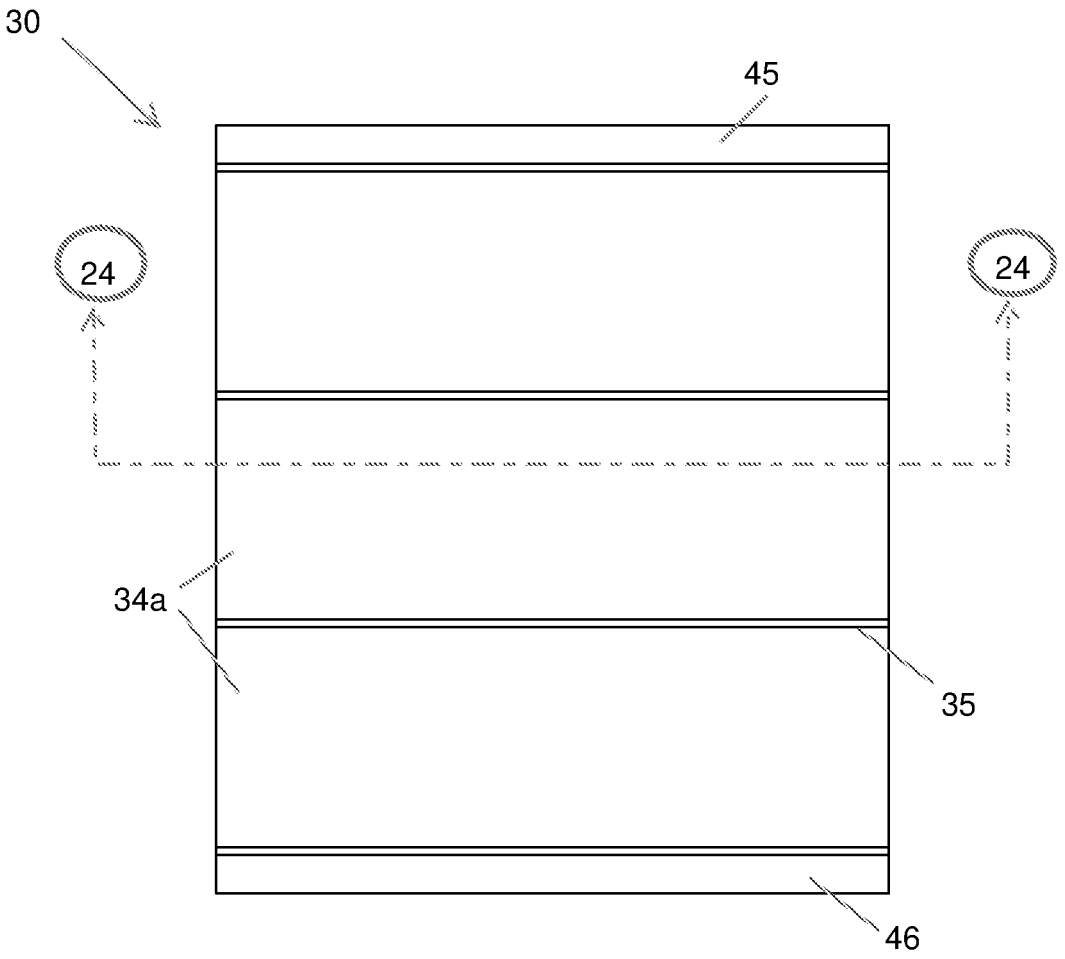
FIG. 21 is a front elevational view of the stiff wall panel assembly shown in FIG. 19, in accordance with a non-limiting exemplary embodiment of the present disclosure.
Figure 22:
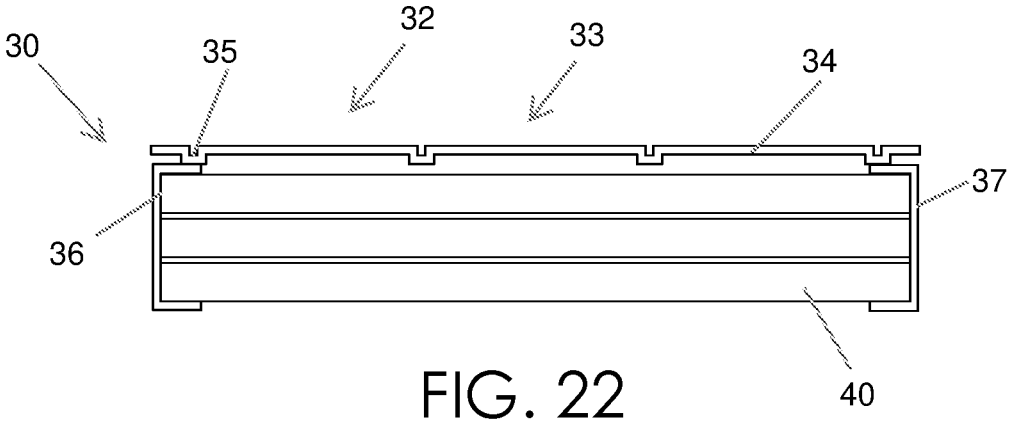
FIG. 22 is a side elevational view of the stiff wall panel assembly shown in FIG. 19, in accordance with a non-limiting exemplary embodiment of the present disclosure.
Figure 23:
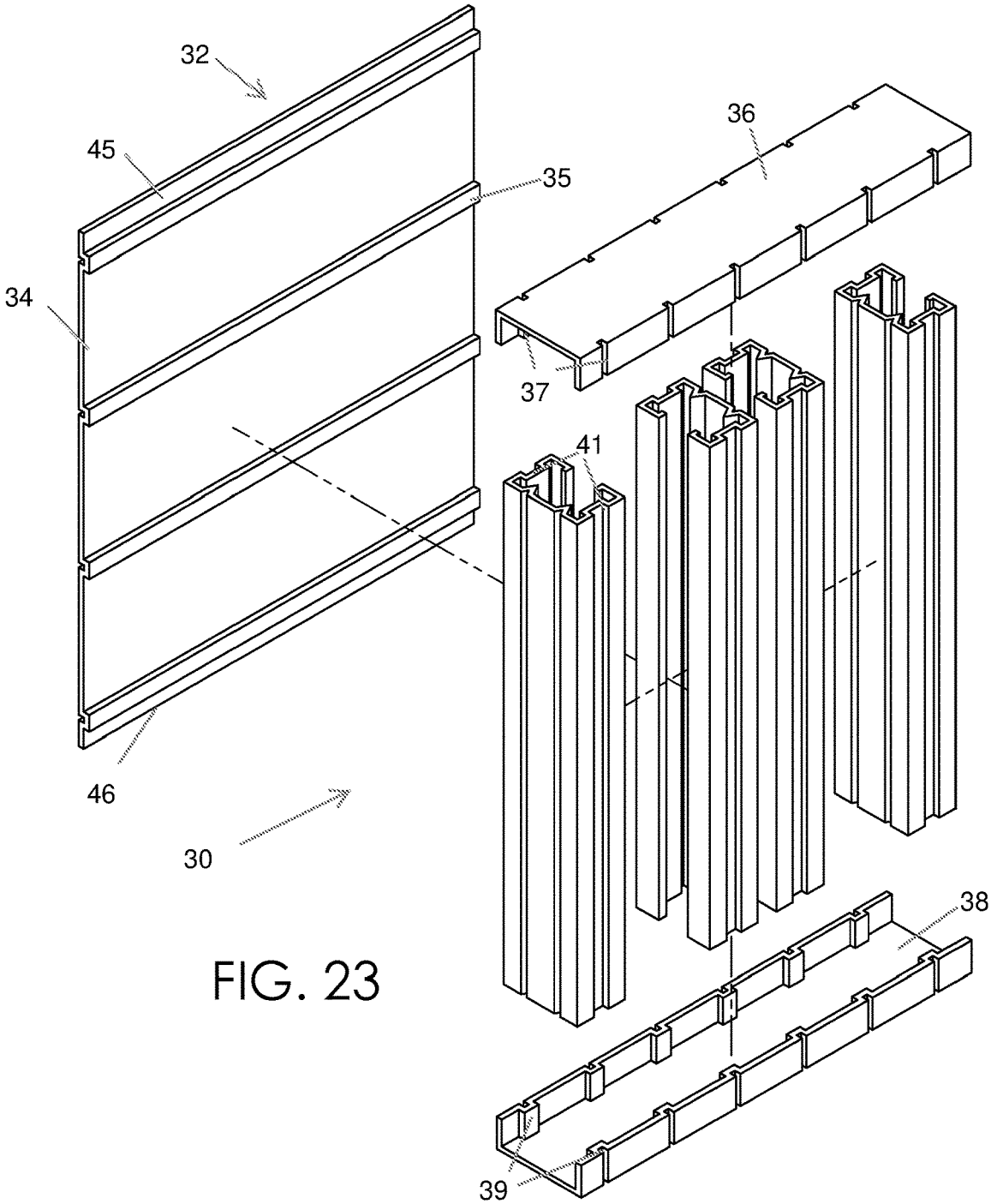
FIG. 23 is an exploded view of the stiff wall panel assembly shown in FIG. 19, in accordance with a non-limiting exemplary embodiment of the present disclosure.
Figure 24:
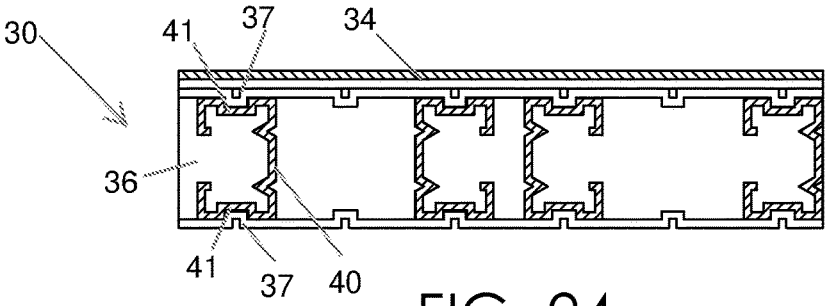
FIG. 24 is a cross-sectional view taken along line 24-24 in FIG. 21, in accordance with a non-limiting exemplary embodiment of the present disclosure.
Figure 25:
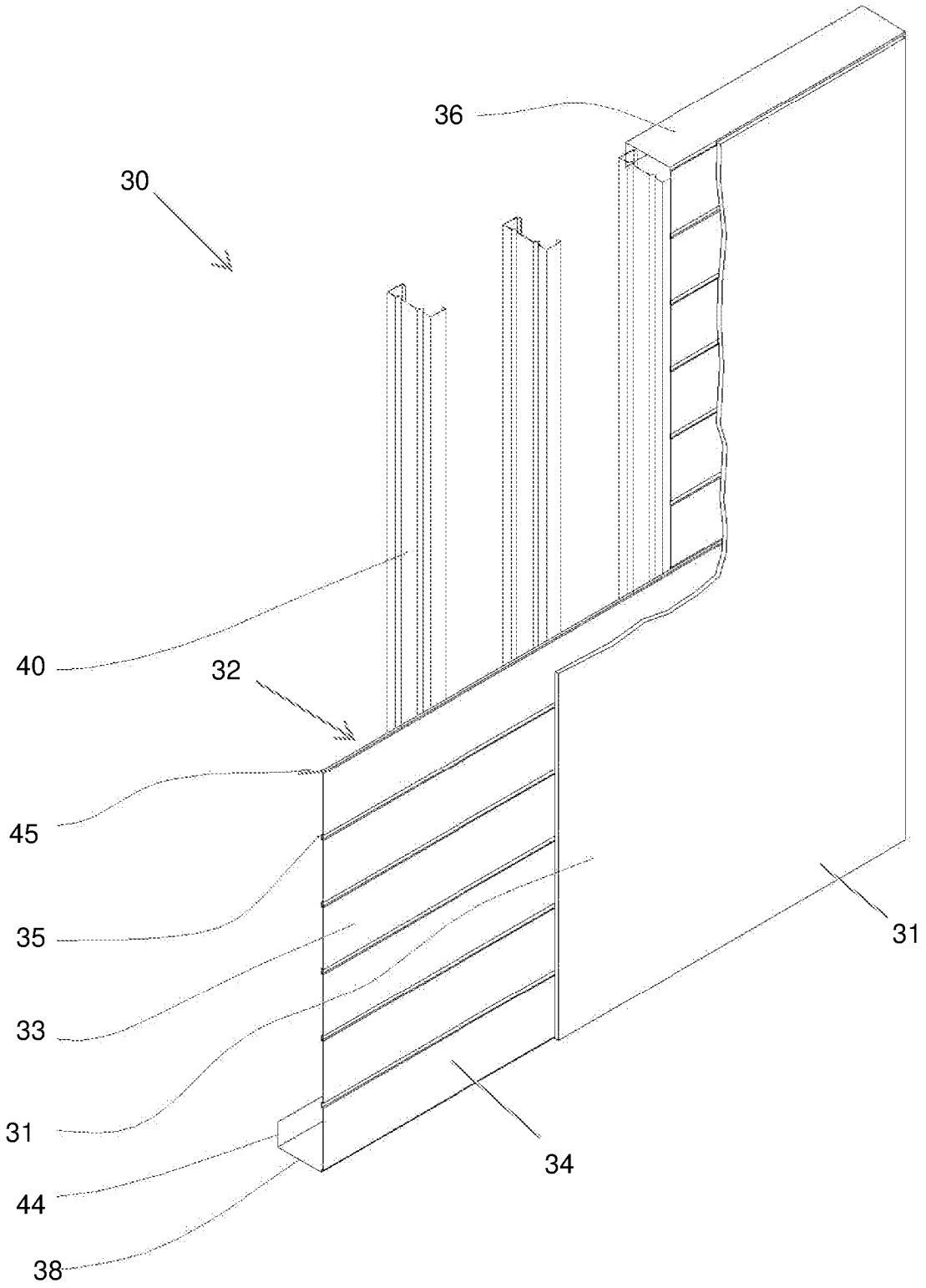
FIG. 25 is a partially exposed perspective view of a stiff wall panel assembly having a sheathing affixed to a front surface thereof, in accordance with a non-limiting exemplary embodiment of the present disclosure.
Figure 26:
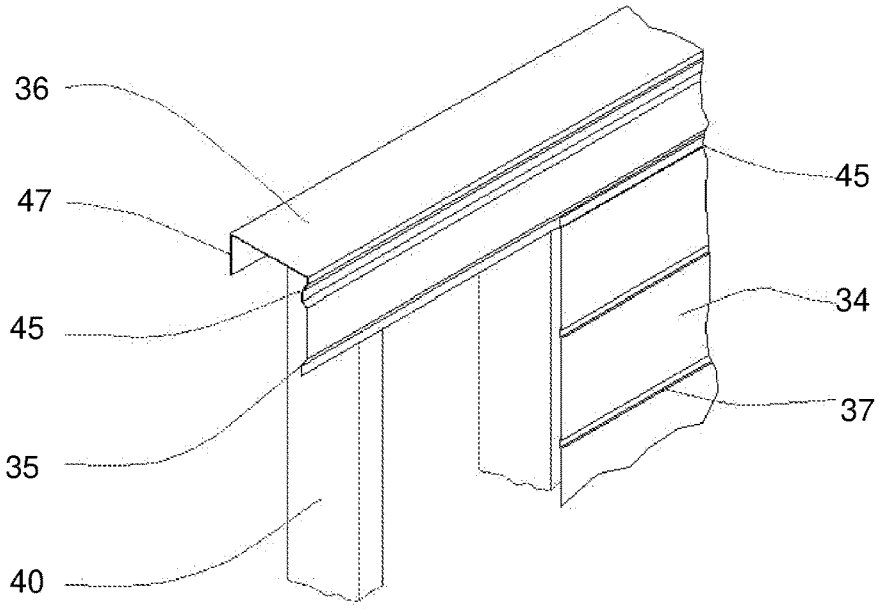
FIG. 26 is a perspective view of a stiff wall panel assembly having a portion of a wall panel extended along the top wall track, in accordance with a non-limiting exemplary embodiment of the present disclosure.
Figure 27:
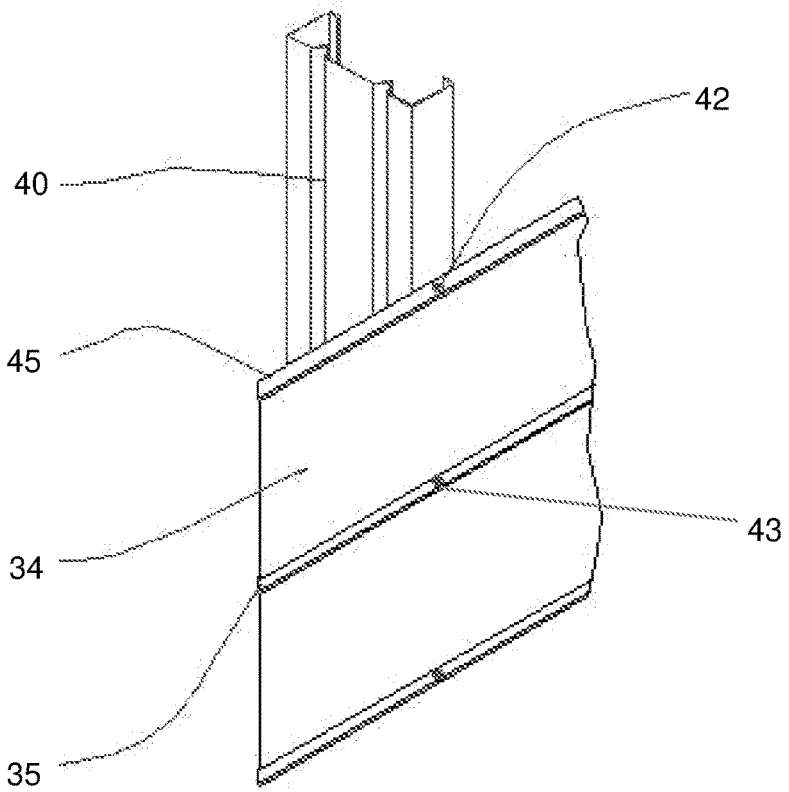
FIG. 27 is a perspective view of a stiff wall panel assembly wherein the wall panel is affixed, via a fastener, to the orthogonally oriented stud, in accordance with a non-limiting exemplary embodiment of the present disclosure.
Figure 28:
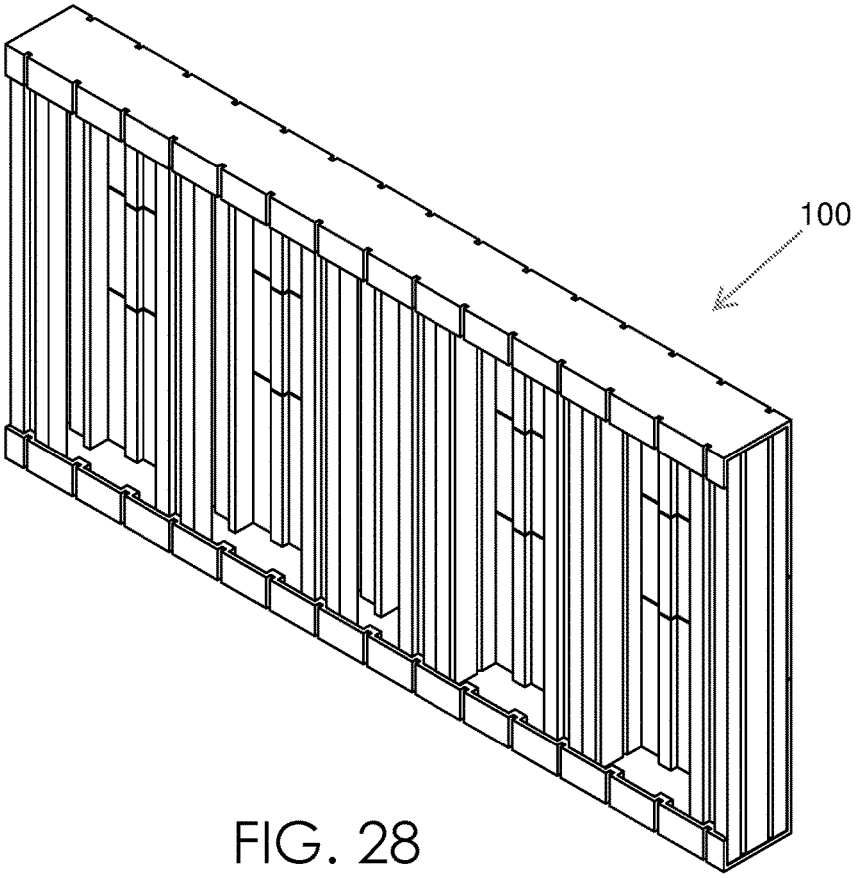
FIG. 28 is a perspective view of a modular stiff wall panel assembly employing conventional studs without reinforcing ribs, in accordance with a non-limiting exemplary embodiment of the present disclosure.
Figure 29:
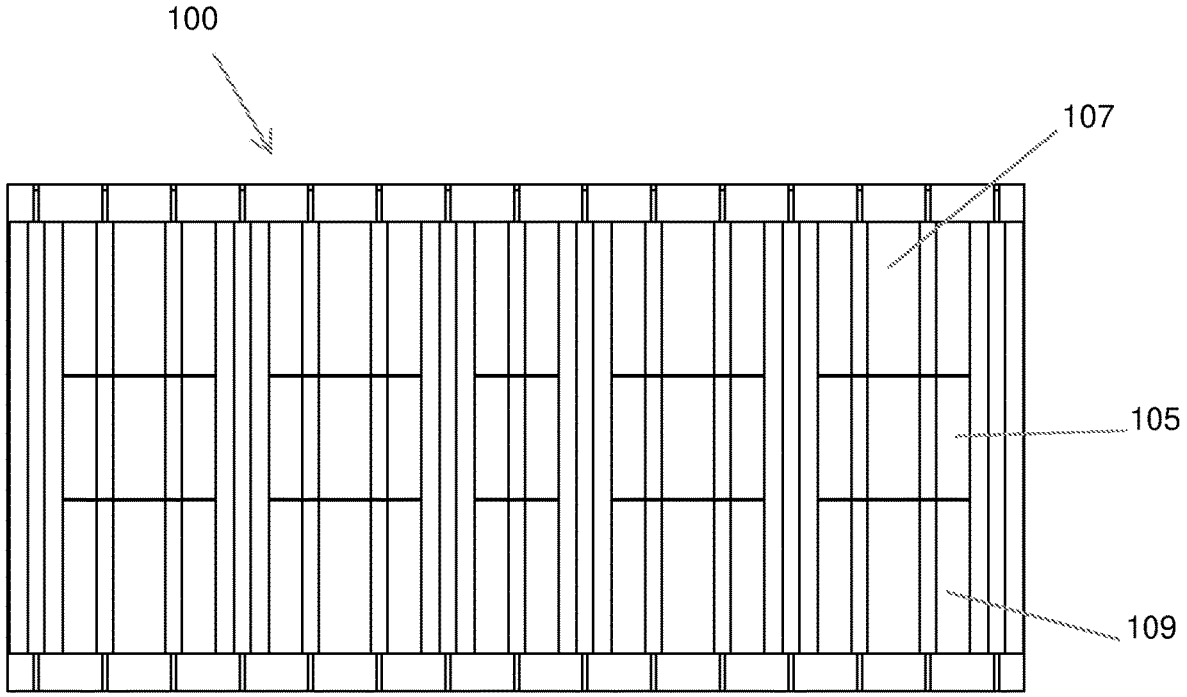
FIG. 29 is a front elevational view of the modular stiff wall panel assembly shown in FIG. 28, in accordance with a non-limiting exemplary embodiment of the present disclosure.
Figure 30:
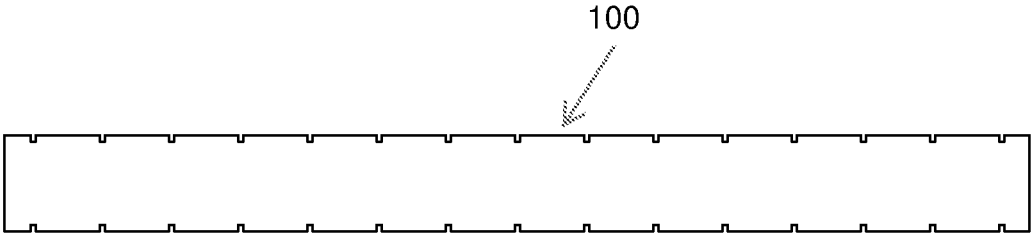
FIG. 30 is a top plan view of the modular stiff wall panel assembly shown in FIG. 28, in accordance with a non-limiting exemplary embodiment of the present disclosure.
Figure 31:
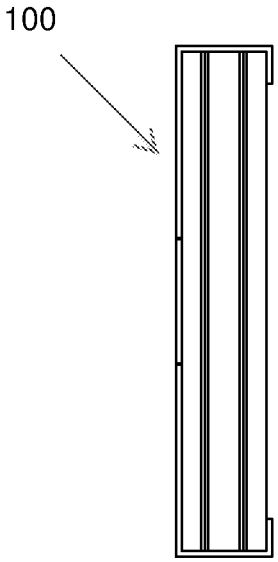
FIG. 31 is a side elevational view of the modular stiff wall panel assembly shown in FIG. 28, in accordance with a non-limiting exemplary embodiment of the present disclosure.
Figure 32:
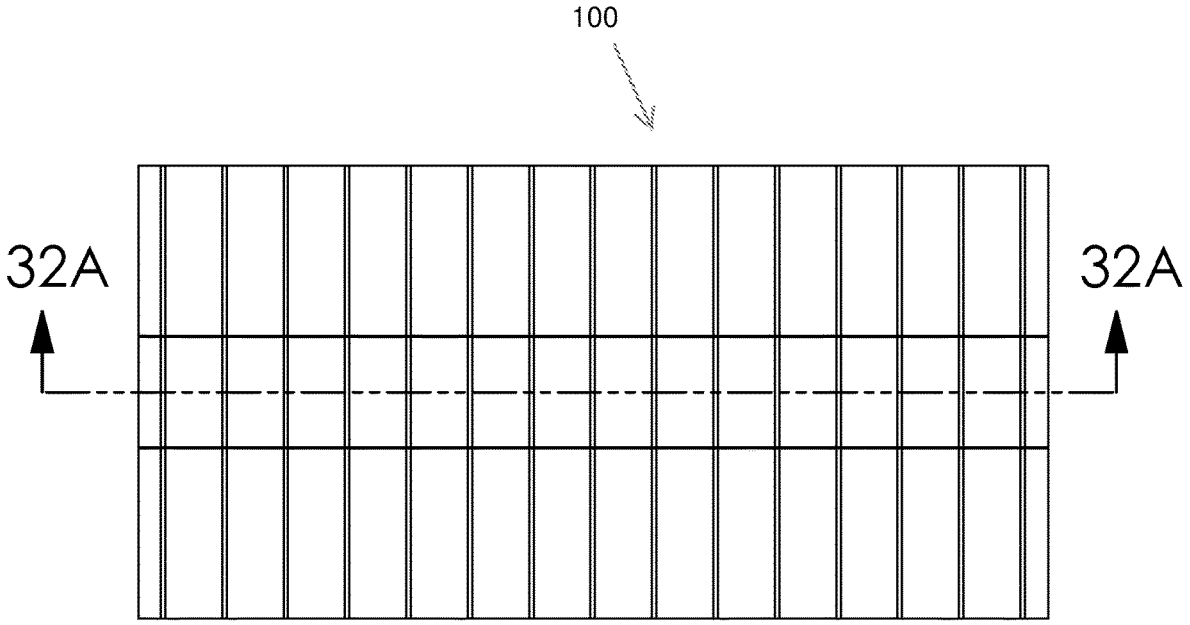
FIG. 32 is a rear elevational view of the modular stiff wall panel assembly shown in FIG. 28, in accordance with a non-limiting exemplary embodiment of the present disclosure.
Figure 32A:
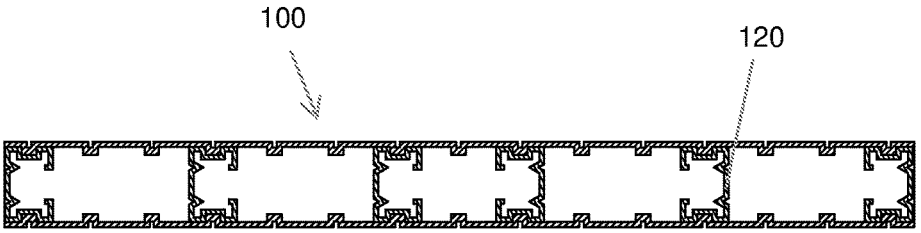
FIG. 32A is a cross-sectional view taken along lien 32A-32A in FIG. 32, in accordance with a non-limiting exemplary embodiment of the present disclosure.
Figure 33:
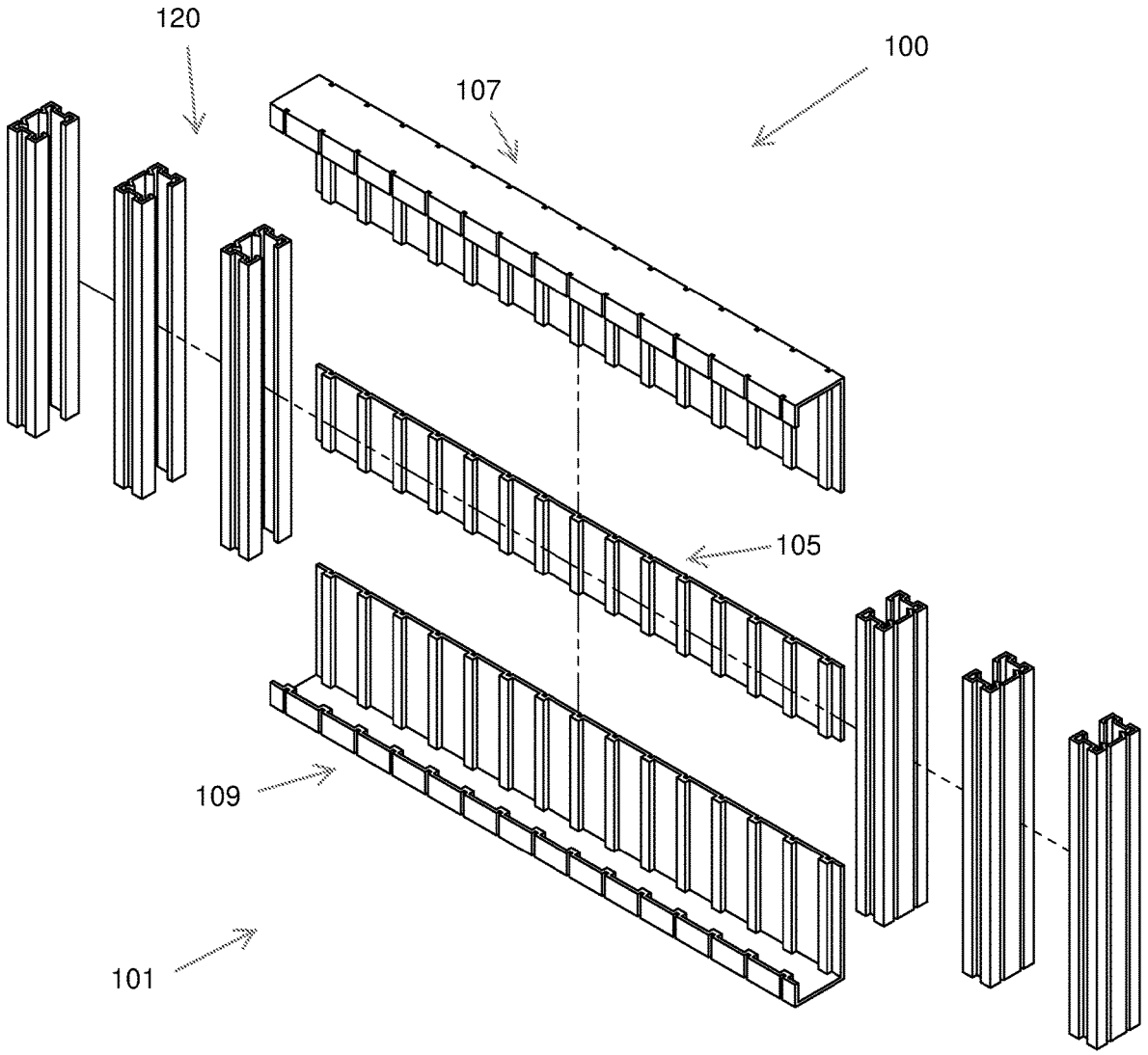
FIG. 33 is an exploded view of the modular stiff wall panel assembly shown in FIG. 28, in accordance with a non-limiting exemplary embodiment of the present disclosure.
Figure 34:
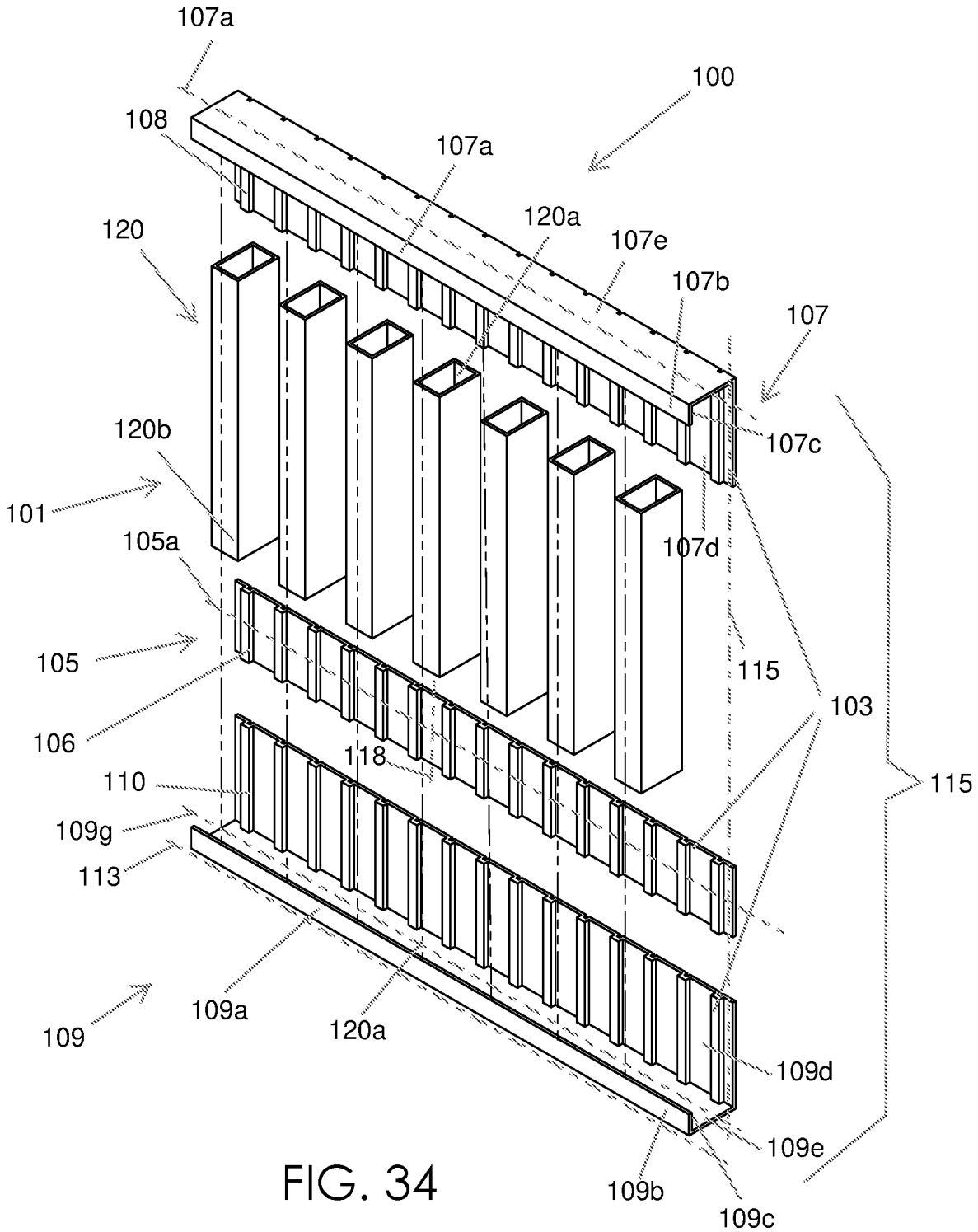
Figure 35:
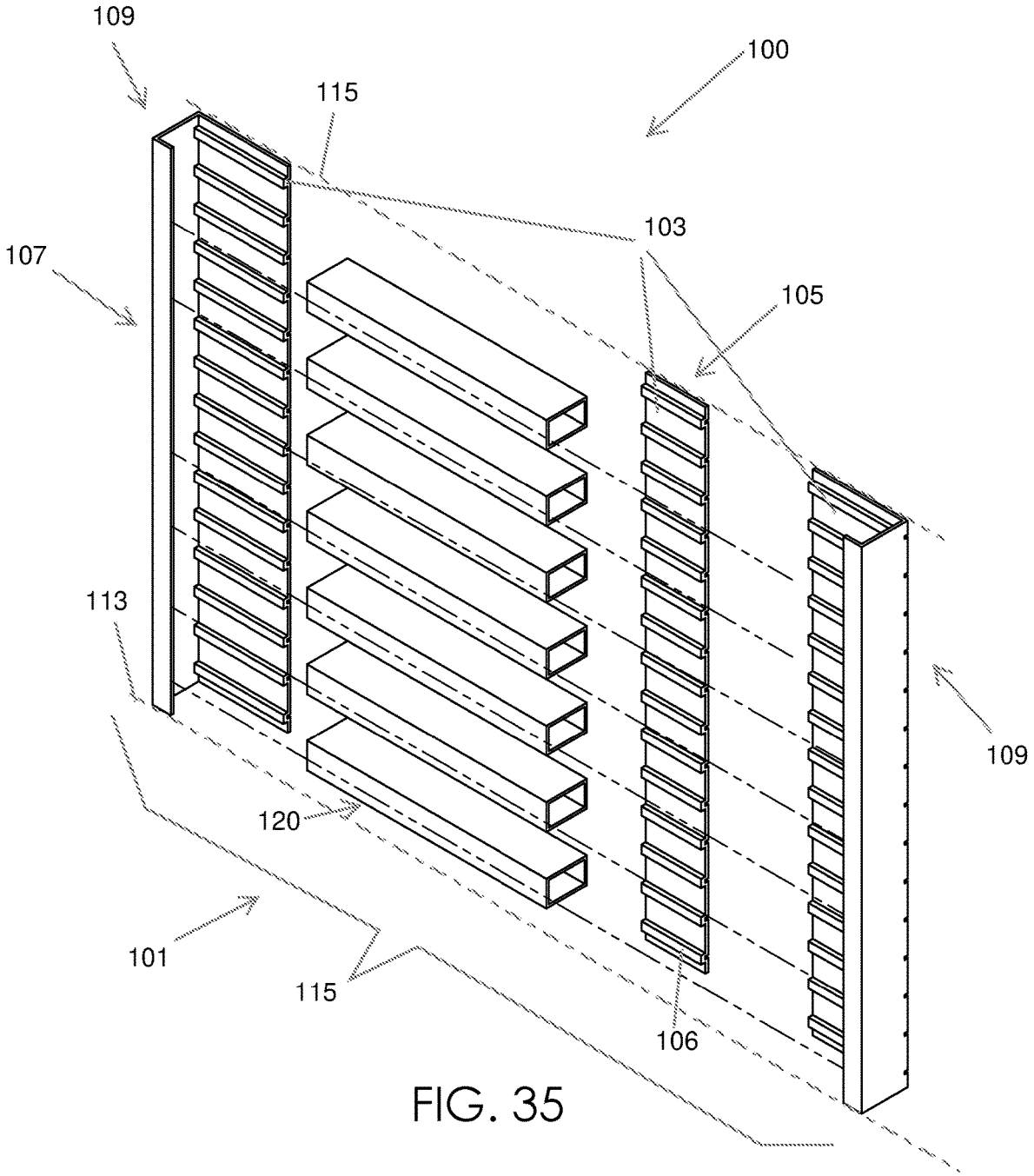

FIG. 34 is an exploded view of another modular stiff wall panel assembly without reinforcing ribs at its stiffening lips and with vertical conventional studs without reinforcing ribs, in accordance with a non-limiting exemplary embodiment of the present disclosure; and FIG. 35 is an exploded view of another modular stiff wall panel assembly without reinforcing ribs at its stiffening lips and with horizontal conventional studs without reinforcing ribs, in accordance with a non-limiting exemplary embodiment of the present disclosure.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about," "generally," and "approximately" mean nearly and in the context of a numerical value or range set forth means±15% of the numerical.

If used herein, "substantially" means largely if not wholly that which is specified but so close that the difference is insignificant.

A non-limiting exemplary embodiment(s) of the present disclosure is referred to generally in the figures and is intended to provide a specially configured steel stiff wall panel assembly for providing improved resistance to shear forces, racking forces, and impact forces. It should be understood that the exemplary embodiment(s) may be used to erect many building structures, and should not be limited to any particular building structure described herein.

The non-limiting exemplary embodiment(s) is/are referred to generally in FIGS. 1-27 and is/are intended to provide a stiff wall panel assembly 30 provides an exterior sheathing 31 substrate on walls and roofs. The stiff wall panel assembly 30 is installed on the exterior face of the wall framing and or roof framing. Additional building/finish materials (e.g., sheathing 31) are then installed over the stiff wall panel assembly 30. Benefits provided by the properties of the stiff wall panel assembly 30 are: impact resistant (missile projection); resists high wind forces; provides lateral stability of the structure; conceals fasteners (eliminates fastener head projection so as not to interfere with finish materials); and provides additional vertical strength to wall assemblies which in turn allows for flexibility in framing layout.

FIGS. 1-27 disclose various embodiments of a stiff wall panel assembly 30 for a building structure. The stiff wall panel assembly 30 includes a wall panel 32 including a single, continuous, and unitary layer 33 extended along an entire surface area of the wall panel 32. Such a single, continuous, and unitary layer 33 includes a central portion 34 having a plurality of central ribs 35 spaced therealong, a first wall track 36 engaged with the central portion 34 and having a plurality of first ribs 37 spaced therealong, and a second wall track 38 engaged with the central portion 34 and having a plurality of second ribs 39 spaced therealong. A plurality of studs 40 are engaged with the central portion 34, the first wall track 36, and the second wall track 38. Such studs 40 have a plurality of third ribs 41 each engaged with the central ribs 35, the first ribs 37, and the second ribs 39. Advantageously, the first ribs 37 and the second ribs 39 each are linearly interlocked as well as linearly and slidably interfitted within the third ribs 41 of the studs 40. Advantageously, the first ribs 37 and the second ribs 39 each are parallel to the third ribs 41 of the studs 40. Notably, the first ribs 37 and the second ribs 39 each having a longitudinal length shorter than a longitudinal length of the third ribs 41 of the studs 40. Such a structural configuration yields the new, useful, and unpredicted result of improved resistance to shear forces, racking forces, and impact forces.

In a non-limiting exemplary embodiment, the first wall track 36 is oriented parallel to the second wall track 38. Such a structural configuration yields the new, useful, and unpredicted result of improved resistance to shear forces, racking forces, and impact forces.

In a non-limiting exemplary embodiment, the central ribs 35 are integral with the central portion 34 and linearly extended therealong. Such a structural configuration yields the new, useful, and unpredicted result of improved resistance to shear forces, racking forces, and impact forces.

In a non-limiting exemplary embodiment, the central ribs 35 are parallel to the first ribs 37, the second ribs 39, and the third ribs 41. Such a structural configuration yields the new, useful, and unpredicted result of improved resistance to shear forces, racking forces, and impact forces.

In a non-limiting exemplary embodiment, the central ribs 35 are linearly interlocked as well as linearly and slidably interfitted with the third ribs 41 of the studs 40. Such a structural configuration yields the new, useful, and unpredicted result of improved resistance to shear forces, racking forces, and impact forces.

In a non-limiting exemplary embodiment, the central ribs 35 are orthogonal to the first ribs 37, the second ribs 39, and the third ribs 41. Such a structural configuration yields the new, useful, and unpredicted result of improved resistance to shear forces, racking forces, and impact forces.

In a non-limiting exemplary embodiment, a plurality of fasteners 42 connected to a plurality of intersecting junctures 43 of the central ribs 35 and the third ribs 41 of the studs 40, respectively. Such a structural configuration yields the new, useful, and unpredicted result of improved resistance to shear forces, racking forces, and impact forces.

In a non-limiting exemplary embodiment, the central portion 34 is integral and monolithic with the first wall track 36 and the second wall track 38. Such a structural configuration yields the new, useful, and unpredicted result of improved resistance to shear forces, racking forces, and impact forces.

In a non-limiting exemplary embodiment, each of the first wall track 36 and the second wall track 38 has a single stiffening lip 44 longitudinally extended orthogonal to the studs 40 and oppositely spaced from the central portion 34. Advantageously, the first ribs 37 and the second ribs 39 are located at the single stiffening lip 44, respectively. Such a structural configuration yields the new, useful, and unpredicted result of improved resistance to shear forces, racking forces, and impact forces.

In a non-limiting exemplary embodiment, the central portion 34 is separate from and detachably coupled to each of the first wall track 36 and the second wall track 38. Such a structural configuration yields the new, useful, and unpredicted result of improved resistance to shear forces, racking forces, and impact forces.

In a non-limiting exemplary embodiment, the central portion 34 has a first tongue 45 and a second tongue 46 located at opposed perimeter edges of the central portion 34. Advantageously, each of the first tongue 45 and the second tongue 46 is rectilinear and parallel to the central ribs 35, respectively. Such a structural configuration yields the new, useful, and unpredicted result of improved resistance to shear forces, racking forces, and impact forces.

In a non-limiting exemplary embodiment, each of the first wall track 36 and the second wall track 38 has a pair of stiffening lips 47, 48 longitudinally extended orthogonal to the studs 40. Advantageously, a first one of the stiffening lips 47 is directly connected to the central wall panel 32 and a second one of the stiffening lips 48 is oppositely spaced from the central wall panel 32. In this manner, the first ribs 37 of the first wall track 36 and the second ribs 39 of the second wall track 38 are located at the first one 47 and the second one 48 of the stiffening lips associated with each of the first wall track 36 and the second wall track 38, respectively.

Such a structural configuration yields the new, useful, and unpredicted result of improved resistance to shear forces, racking forces, and impact forces.

In a non-limiting exemplary embodiment, the stiff wall panel assembly 30 is constructed of various metal gauges (ideal range 22 to 20 gauge). Repetitive grooves (ribs 35) are rolled or bent in the material to provide rigidity and act as a fastening flange. The sides of the wall panel 32 are laid out to overlap with adjacent panels on all four sides.

In a non-limiting exemplary embodiment, the stiff wall panel assembly 30 includes a "built-in" top 36 and bottom track 38 which accepts vertical studs 40 (framing members).

In a non-limiting exemplary embodiment, the stiff wall panel assembly 30 includes individual top 36 and bottom tracks 38 which mate with a standard stiff panel sheet 32.

Referring to the FIGS. 1-27, in a non-limiting exemplary embodiment(s), the present disclosure provides the following new, useful, and unexpected benefits: track is built into panels and laid out with "S" ribs; added shear 300-400% more than plywood; non-combustible; impact resistant; greater pullout strength for sidings and finish (e.g., nail pulled out from wood panel requires about 80 lbs. Nail pulled out from steel panel 32 requires about 250-350 lbs.); seismic and wind rated for over 200 mph; bearing capacity is up to 2000 lbs loads between studs 40 and loading over studs 40 can be 8000-45,000 lbs by changing a gauge of the wall stud 40; uplift attachment plates/clips provide ten times more capacity than a screw or standard clip; cost effective; less labor; and recessed screws.

The present disclosure further provides the following additional new, useful, and unexpected benefits: impact resistant; non-combustible; shear panel; increased racking force; pre-layouts; recessed screw attachments; horizontal rib panel thermal break; increased load capacity in between studs 40; and increased capability by adding additional fasteners 42.

In a non-limiting exemplary embodiment, the present disclosure includes horizontal 0.5 inch deep ribs 35 running across the wall panel 32 with ribs 37, 39 on top and bottom lips of tracks 36, 38.

In a non-limiting exemplary embodiment, the present disclosure includes stud ribs 41 running down the wall panel 32 for flush panel.

The stiff wall panel assembly 30 includes a wall panel 32 having a centrally registered longitudinal axis and including a single, continuous, and unitary layer 33 extended along an entire surface area of the wall panel 32. Such a single, continuous, and unitary layer 33 includes a central portion 34, a first wall track 36 axially and a second wall track 38 axially opposed therefrom. The first wall track 36 and the second wall track 38 are axially offset along the centrally registered longitudinal axis and monolithically connected to the central portion 34, and a plurality of ribs 35 juxtaposed and spaced apart along the wall panel 32. Advantageously, the ribs are integral with the central portion 34 and linearly extended therealong. Notably, the first wall track 36 and the second wall track 38 are non-planar relative to the central portion 34.

In a non-limiting exemplary embodiment, the present disclosure further includes a plurality of wall studs 40 statically affixed to the wall panel 32 and statically engaged with the ribs 37, 39, a floor beam may be statically connected to the second wall track 38, a plurality of floor joists may be positioned on an existing support surface and engaged with the wall panel 32 and the floor beam, and a plurality of fasteners 42 engaged with the wall panel 32, the wall studs 40, and the floor beam, and the floor joists.

In a non-limiting exemplary embodiment, the single, continuous, and unitary layer 33 further includes a linear left edge and a linear right edge each extended along the central portion 34 and equidistantly offset from the central registered longitudinal axis.

In a non-limiting exemplary embodiment, the central portion 34 includes a plurality of planar sections 34*a* intercalated between the plurality of ribs 35 and extended along an entire longitudinal length of the ribs 35.

In a non-limiting exemplary embodiment, the wall studs 40 are statically engaged directly with the central portion 34, the first wall track 36, and the second wall track 38.

In a non-limiting exemplary embodiment, the ribs 35 protrude outwardly from an anterior face of the central portion 34.

In a non-limiting exemplary embodiment, the ribs 35 are equidistantly spaced apart.

In a non-limiting exemplary embodiment, the first wall track 36 and the second wall track 38 are integral and monolithically connected to the central portion 34.

In a non-limiting exemplary embodiment, the single, continuous, and unitary layer 33 consists of a single sheet of steel.

In a non-limiting exemplary embodiment, the wall studs 40 include a single, continuous, and unitary body including a single sheet of steel.

In a non-limiting exemplary embodiment, the ribs 35 are coextensively shaped and oriented perpendicular to the first wall track 36 and the second wall track 38.

In a non-limiting exemplary embodiment, the ribs 35 are coextensively shaped and oriented parallel to the first wall track 36 and the second wall track 38. Such ribs 35 are extended from the first wall track 36 to the second wall track 38.

In a non-limiting exemplary embodiment, each of the first wall track 36 and the second wall track 38 are L-shaped or U-shaped.

In a non-limiting exemplary embodiment, a depth of each of the first wall track 36 and the second wall track 38 is equal to a depth of the wall studs 40.

In a non-limiting exemplary embodiment, a latitudinal width of the central portion 34 is equal to a longitudinal length of the floor beam.

In a non-limiting exemplary embodiment, the ribs 35 span across an entire latitudinal width of the wall panel 32.

In a non-limiting exemplary embodiment, the wall studs 40 have axially opposed ends directly connected to the first wall track 36 and the second wall track 38.

In a non-limiting exemplary embodiment, the wall studs 40 are directly and statically affixed to the ribs 35 via the fasteners 42.

In a non-limiting exemplary embodiment, the ribs 35 are spaced apart approximately six to sixteen inches or twenty-four inches apart.

Referring to FIGS. 28-35, in a non-limiting exemplary embodiment(s), a modular stiff wall panel assembly 100 for a building structure is disclosed. Advantageously, the assembly 100 will be totally supported by at least one wall track (e.g., first wall track 107 and/or second wall track 109). In minutes, the modular stiff wall panel assembly 100 is completely laid out and then the studs 120 are fastened in place at the (bottom wall track) second wall track 109. Pop on the first wall track 107 (top wall track) to lock in the other ends of the studs 120. An entire building's walls can be erected in less time and with fewer installers and materials. The top wall track 109 also can be the same or heavier gauge as the bottom wall track 107 to act as a header along with lateral shear. The central portion 105 can be lighter or heavier gauge relative to the first wall track 107 and second wall track 109, for economy or structural integrity.

Advantageously, the modular stiff wall panel assembly 100 is constructed from the bottom wall track (second wall track 109) and supported with studs 120 up to a top of the assembly 100, which has a header (top wall track) first wall track 107. As noted above, one or more central portions 105 may have various gauges to fill in remaining spaces. Advantageously, a return lip (single stiffening lip 107*a*) on first wall track 107 may be between 3-6 inches tall. Such a single stiffening lip 107*a* provides added strength so that additional axial load can be increased. The second wall track 109 (bottom wall track) also has a return lip (single stiffening lip 109*a*) that may be about 2 inches tall.

Such a modular stiff wall panel assembly 100 includes a modular wall panel 101 having a body 102 provided with a plurality of single, continuous, and unitary layers 103 extended along an entire surface area of the modular wall panel 101. The plurality of single, continuous, and unitary layers 103 include a central portion 105 having a plurality of central ribs 106 spaced therealong, a first wall track 107 engaged with the central portion 105 and having a plurality of first ribs 108 spaced therealong, and a second wall track 109 engaged with the central portion 105 and having a plurality of second ribs 110 spaced therealong (wherein the second wall track 109 is oppositely spaced from the first wall track 107) and a plurality of studs 120 engaged with the central portion 105, the first wall track 107, and the second wall track 109. Advantageously, the central ribs 106, the first ribs 108, and the second ribs 110 are linearly aligned, respectively, and registered parallel to a longitudinal axis 120*a* of the studs 120, respectively. Advantageously, the central ribs 106, the first ribs 108, and the second ribs 110 are coplanar on a single plane 115 and disposed at an end-to-end pattern along an entire longitudinal length 101*a* of the modular wall panel 101. Such a structural configuration yields the new, useful, and unexpected results of reducing material, labor, and time to erect the modular stiff wall panel assembly 100.

In a non-limiting exemplary embodiment, FIG. 34, each of the longitudinal length 101*a* of the modular wall panel 101 and the longitudinal axis 120*a* of the studs 120 is oriented orthogonal to a horizontal ground surface 113.

In a non-limiting exemplary embodiment, FIG. 35, each of the longitudinal length 101*a* of the modular wall 101 panel and the longitudinal axis 120*a* of the studs 120 is oriented parallel to a horizontal ground surface 113.

In a non-limiting exemplary embodiment, the central ribs 106 are equidistantly spaced along the central portion 105 and registered orthogonal to a longitudinal axis 105*a* of the central portion 105.

In a non-limiting exemplary embodiment, the first ribs 108 are registered orthogonal to a longitudinal axis 107*g* of the first wall track 107.

In a non-limiting exemplary embodiment, the second ribs 110 are registered orthogonal to a longitudinal axis 109*g* of the second wall track 109.

In a non-limiting exemplary embodiment, the first wall track 107 is oriented parallel to the second wall track 109 and spaced apart therefrom.

In a non-limiting exemplary embodiment, the central ribs 106 are integral with the central portion 105 and linearly parallel to a latitudinal axis 118 thereof.

In a non-limiting exemplary embodiment, the central ribs 106 are parallel to the first ribs 108 and the second ribs 110.

In a non-limiting exemplary embodiment, the central ribs 106, the first ribs 108, and the second ribs 110 are linearly disposed along the single plane 115.

In a non-limiting exemplary embodiment, each of the first ribs 108, the second ribs 110, and the central ribs 106 are rectilinear.

In a non-limiting exemplary embodiment, a plurality of fasteners (not shown) may be connected to a plurality of abutted edges of the first wall track 107, the second wall track 109, and the central portion 105, respectively.

In a non-limiting exemplary embodiment, the central portion 105 is removably attached to the studs 120.

In a non-limiting exemplary embodiment, each of the first wall track 107 and the second wall track 109 has a single stiffening lip 107*a*, 109*a* longitudinally extended orthogonal to the studs 120 and oppositely spaced from the central portion 105. Advantageously, the first ribs 108 and the second ribs 110 are spaced from the single stiffening lip 107*a*, 109*a*, respectively. This allows studs 120 to be reinforced at the first wall track 107 and second wall track 109 and thereby improve shear load resistance and tensional load resistance.

In a non-limiting exemplary embodiment, the central portion 105 is separate from and detachably coupled to each of the first wall track 107 and the second wall track 109.

In a non-limiting exemplary embodiment, each single stiffening lip 107*a*, 109*a* has a continuous planar anterior face 107*b*, 109*b* and a continuous planar posterior face 107*c*, 109*c*, respectively.

In a non-limiting exemplary embodiment, the first wall track 107 includes a first primary side 107*d* having first ribs 108, a first base 107*e* integral with the first primary side 107*d* and oriented perpendicular thereto, and a first stiffening lip 107*a* integral with the first base 107*e* and oriented perpendicular thereto. Advantageously, the first stiffening lip 107*a* is spaced from the first ribs 108 and has a first planar anterior face 107*b* as well as a first planar posterior face 107*c* oriented parallel to the first primary side 107*d*. Advantageously, a proximal end 120*a* of studs 120 is intercalated between the first primary side 107*d* and the first stiffening lip 107*a*. This allows studs 120 to be reinforced at the first wall track 107 and thereby improves shear load resistance and tensional load resistance.

In a non-limiting exemplary embodiment, the second wall track 109 includes a second primary side 109*d* having the second ribs 110, a second base 109*e* integral with the second primary side 109*d* and oriented perpendicular thereto, and a second stiffening lip 109*a* integral with the second base 109*e* and oriented perpendicular thereto. Advantageously, the second stiffening lip 109*a* is spaced from the second ribs 110 and has a second planar anterior face 109*b* as well as a second planar posterior face 109*c* oriented parallel to the second primary side 109*d*. Advantageously, a distal end 120*b* of studs 120 is intercalated between the second primary side 109*d* and the second stiffening lip 109*a*. This allows studs 120 to be reinforced at second wall track 109 and thereby improves shear load resistance and tensional load resistance.

In a non-limiting exemplary embodiment, the central ribs 106 begin and terminate at the central portion 105. Advantageously, the first ribs 108 begin and terminate at the first wall track 107 and the second ribs 110 begin and terminate at the second wall track 109.

In a non-limiting exemplary embodiment, each of the studs 120 has a proximal end 120*a* and a distal end 120*b* directly abutted with the first wall track 107 and the second wall track 109, respectively.

While various embodiments have been described, the description is intended to be exemplary, rather than limiting, and it is understood that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various examples for the purpose of streamlining the disclosure. This method of disclosure is not to be interpreted as reflecting an intention that the claims require more features than are expressly recited in each claim. Rather, as the following claims reflect, inventive subject matter lies in less than all features of a single disclosed example. Thus, the following claims are hereby incorporated into the Detailed Description, with each claim standing on its own as a separately claimed subject matter.

What is claimed as new and what is desired to secure by Letters Patent of the United States is:

1. A modular stiff wall panel assembly for a building structure, comprising: a modular wall panel including a body having a plurality of single, continuous, and unitary layers extended along an entire surface area of said modular wall panel; said plurality of single, continuous, and unitary layers including a central portion having a plurality of central ribs spaced therealong;

a first wall track engaged with said central portion and having a plurality of first ribs spaced therealong; and a second wall track engaged with said central portion and having a plurality of second ribs spaced therealong, said second wall track being oppositely spaced from said first wall track; and a plurality of studs engaged with said central portion, said first wall track, and said second wall track;

wherein said central ribs, said first ribs, and said second ribs are linearly aligned, respectively, and registered parallel to a longitudinal axis of said studs, respectively;

wherein said central ribs, said first ribs, and said second ribs are coplanar on a single plane and disposed at an end-to-end pattern along an entire longitudinal length of said wall panel.

2. The stiff wall panel assembly of claim 1, wherein each of said longitudinal length of said wall panel and said longitudinal axis of said studs is oriented orthogonal to a horizontal ground surface.

3. The stiff wall panel assembly of claim 1, wherein each of said longitudinal length of said wall panel and said longitudinal axis of said studs is oriented parallel to a horizontal ground surface.

4. The stiff wall panel assembly of claim 1, wherein said central ribs are equidistantly spaced along said central portion and registered orthogonal to a longitudinal axis of said central portion.

5. The stiff wall panel assembly of claim 1, wherein said first ribs are registered orthogonal to a longitudinal axis of said first wall track.

6. The stiff wall panel assembly of claim 1, wherein said seconds ribs are registered orthogonal to a longitudinal axis of said second wall track.

7. The stiff wall panel assembly of claim 1, wherein said first wall track is oriented parallel to said second wall track and spaced apart therefrom.

8. The stiff wall panel assembly of claim 1, wherein said central ribs are integral with said central portion and linearly parallel to a latitudinal axis thereof.

9. The stiff wall panel assembly of claim 1, wherein said central ribs are parallel to said first ribs and said second ribs.

10. The stiff wall panel assembly of claim 1, wherein said central ribs, said first ribs, and said second ribs are linearly disposed along said single plane.

11. The stiff wall panel assembly of claim 1, wherein each of said first ribs, said second ribs, and said central ribs are rectilinear.

12. The stiff wall panel assembly of claim 1, wherein said central portion is removably attached to said studs.

13. The stiff wall panel assembly of claim 1, wherein each of said first wall track and said second wall track has a single stiffening lip longitudinally extended orthogonal to said studs and oppositely spaced from said central portion, wherein said first ribs and said second ribs are spaced from said single stiffening lip, respectively.

14. The stiff wall panel assembly of claim 1, wherein said central portion is separate from and detachably coupled to each of said first wall track and said second wall track.

15. The stiff wall panel assembly of claim 1, wherein said each of said single stiffening lip has a continuous planar anterior face and a continuous planar posterior face.

16. The stiff wall panel assembly of claim 1, wherein said first wall track includes a first primary side having said first ribs;

a first base integral with said first primary side and oriented perpendicular thereto; and a first stiffening lip integral with said first base and oriented perpendicular thereto;

wherein said first stiffening lip is spaced from said first ribs and has a first planar anterior face as well as a first planar posterior face oriented parallel to said first primary side;

wherein a proximal end of each of said studs is intercalated between said first primary side and said first stiffening lip.

17. The stiff wall panel assembly of claim 16, wherein said second wall track includes a second primary side having said second ribs;

a second base integral with said second primary side and oriented perpendicular thereto; and a second stiffening lip integral with said second base and oriented perpendicular thereto;

wherein said second stiffening lip is spaced from said second ribs and has a second planar anterior face as well as a second planar posterior face oriented parallel to said second primary side;

wherein a distal end of each of said studs is intercalated between said second primary side and said second stiffening lip.

18. The stiff wall panel assembly of claim 1, wherein said central ribs begin and terminate at said central portion; wherein said first ribs begin and terminate at said first wall track; wherein said second ribs begin and terminate at said second wall track.

19. The stiff wall panel assembly of claim 1, wherein each of said studs has a proximal end and a distal end directly abutted with said first wall track and said second wall track, respectively.

* * * * *